US009093068B2

(12) United States Patent
Jeong et al.

(10) Patent No.: US 9,093,068 B2
(45) Date of Patent: Jul. 28, 2015

(54) METHOD AND APPARATUS FOR PROCESSING AN AUDIO SIGNAL

(75) Inventors: Gyuhyeok Jeong, Seoul (KR); Daehwan Kim, Seoul (KR); Changheon Lee, Seoul (KR); Lagyoung Kim, Seoul (KR); Hyejeong Jeon, Cheongju-si (KR); Byungsuk Lee, Seoul (KR); Ingyu Kang, Cheongju-si (KR)

(73) Assignee: LG Electronics Inc., Seoul (KR)

( * ) Notice: Subject to any disclaimer, the term of this patent is extended or adjusted under 35 U.S.C. 154(b) by 480 days.

(21) Appl. No.: 13/636,922

(22) PCT Filed: Mar. 23, 2011

(86) PCT No.: PCT/KR2011/001989

§ 371 (c)(1),
(2), (4) Date: Dec. 20, 2012

(87) PCT Pub. No.: WO2011/118977

PCT Pub. Date: Sep. 29, 2011

(65) Prior Publication Data

US 2013/0096928 A1 Apr. 18, 2013

Related U.S. Application Data

(60) Provisional application No. 61/316,390, filed on Mar. 23, 2010, provisional application No. 61/451,564, filed on Mar. 10, 2011.

(51) Int. Cl.
*G10L 19/00* (2013.01)
*G10L 19/04* (2013.01)
(Continued)

(52) U.S. Cl.
CPC ..... *G10L 19/04* (2013.01); *G10L 19/06* (2013.01); *G10L 19/22* (2013.01); *G10L 19/24* (2013.01)

(58) Field of Classification Search
CPC ..... G10L 19/04; G10L 19/22; G10L 19/24; G10L 19/06
See application file for complete search history.

(56) References Cited

U.S. PATENT DOCUMENTS 4,379,949 A * 4/1983 Chen et al. ..... 375/240
5,142,581 A * 8/1992 Tokuda et al. ..... 704/219
(Continued)

FOREIGN PATENT DOCUMENTS

CN 101180676 A 5/2008
CN 101548317 A 9/2009
(Continued)

OTHER PUBLICATIONS

Vos, Koen, Soeren Jensen, and Karsten Soerensen. "Silk speech codec." IETF Standards Track Internet-Draft (2009).*
(Continued)

*Primary Examiner* — Brian Albertalli
(74) *Attorney, Agent, or Firm* — Fish & Richardson P.C.

(57) ABSTRACT

The present invention relates to a method for processing an audio signal, comprising: determining bandwidth information indicating to which of a plurality of bands the current frame corresponds; determining information on the order corresponding to the present frame on the basis of the bandwidth information; performing a linear predictive analysis of the present frame to generate a first set linear predictive transform coefficient of a first order; performing a vector quantization on the first set linear predictive coefficient to generate a first index; performing a linear predictive analysis of the current frame to generate a second set linear predictive transform coefficient of a second order in accordance with the information on the order; and performing a vector quantization on a second set difference by using the first set index and the second set linear predictive transform coefficient, when the second set linear predictive coefficient is generated.

12 Claims, 17 Drawing Sheets

(51) Int. Cl.

| | |
|---|---|
| ***G10L 19/22*** | (2013.01) |
| ***G10L 19/24*** | (2013.01) |
| ***G10L 19/06*** | (2013.01) |

(56) References Cited

U.S. PATENT DOCUMENTS

| | | | | |
|---|---|---|---|---|
| 5,283,814 | A | 2/1994 | Iwahashi et al. | |
| 5,463,716 | A * | 10/1995 | Taguchi | 704/209 |
| 5,642,465 | A * | 6/1997 | Scott et al. | 704/220 |
| 5,699,484 | A * | 12/1997 | Davis | 704/200.1 |
| 5,933,803 | A * | 8/1999 | Ojala | 704/223 |
| 6,202,045 | B1 * | 3/2001 | Ojala et al. | 704/203 |
| 6,574,593 | B1 * | 6/2003 | Gao et al. | 704/222 |
| 6,810,381 | B1 * | 10/2004 | Sasaki et al. | 704/500 |
| 8,249,860 | B2 | 8/2012 | Sato et al. | |
| 2002/0143527 | A1 * | 10/2002 | Gao et al. | 704/223 |
| 2004/0024594 | A1 * | 2/2004 | Lee et al. | 704/219 |
| 2006/0149538 | A1 * | 7/2006 | Lee et al. | 704/219 |
| 2007/0005351 | A1 * | 1/2007 | Sathyendra et al. | 704/223 |
| 2009/0138272 | A1 * | 5/2009 | Kim et al. | 704/500 |
| 2010/0106492 | A1 | 4/2010 | Sato et al. | |
| 2011/0313761 | A1 | 12/2011 | Zhang et al. | |

FOREIGN PATENT DOCUMENTS

| | | | |
|---|---|---|---|
| CN | 101615395 | A | 12/2009 |
| EP | 2 101 320 | A1 | 9/2009 |
| EP | 2 385 522 | A1 | 11/2011 |
| JP | 01-238229 | A | 9/1989 |
| JP | 2001-306098 | A | 11/2001 |
| KR | 10-0138115 | B1 | 6/1998 |
| KR | 10-0348137 | B1 | 11/2002 |

OTHER PUBLICATIONS

Zhang, Fan, et al. "Adaptive prediction order scheme for AMR-WB+." Communications and Information Technologies (ISCIT), 2010 International Symposium on. IEEE, 2010.*

Jelinek, Milan, et al. "Itu-t G. EV-VBR baseline codec." Acoustics, Speech and Signal Processing, 2008. ICASSP 2008. IEEE International Conference on. IEEE, 2008.*

Ehara, Hiroyuki, et al. "Predictive VQ for bandwidth scalable LSP quantization." Acoustics, Speech, and Signal Processing, 2005. Proceedings.(ICASSP'05). IEEE International Conference on. vol. 1. IEEE, 2005.*

Nomura, Toshiyuki, et al. "A bitrate and bandwidth scalable CELP coder." Acoustics, Speech and Signal Processing, 1998. Proceedings of the 1998 IEEE International Conference on. vol. 1. IEEE, 1998.*

Bhaskar, B.R.U., "Adaptive predictive coding with transform domain quantization using block size adaptation and high-resolution spectral modeling," Applications of Signal Processing to Audio and Acoustics, 1993. Final Program and Paper Summaries., 1993 IEEE Workshop on , vol., No., pp. 31,34, Oct. 17-20, 1993.*

McElroy, D., B. Murray, and A. D. Fagan. "Wideband speech coding in 7.2 kbit/s." Acoustics, Speech, and Signal Processing, 1993. ICASSP-93., 1993 IEEE International Conference on. vol. 2. IEEE, 1993.*

Ehara, Hiroyuki, Toshiyuki Morii, and Koji Yoshida. "Predictive vector quantization of wideband LSF using narrowband LSF for bandwidth scalable coders." Speech communication 49.6 (2007): 490-500.*

Chinese Office Action dated Jul. 18, 2013 for Application No. 2011-80015619, with English Translation, 13 pages.

International Search report dated Oct. 21, 2011 for Application No. PCT/KR2011/001989, with English Translation, 4 pages.

H.W. Kim et al., The Trend of G.729.1 Wideband Multi-codec Technology, ETRI, Electronics and Telecommunications Trends, Dec. 2006, vol. 2 No. 6, pp. 77-85, See "structure I.G.729.1" of p. 80.

Tony S. Velma et al., "A 6Kbps to 85Kbps Scalable Audio Coder", ICASSP 2000 IEEE International Conference, IEEE, 2000, vol. 2, pp. 877-880, See right colunm of p. 877—right column of p. 878, figure 1.

* cited by examiner (A)

(B)

METHOD AND APPARATUS FOR PROCESSING AN AUDIO SIGNAL

CROSS REFERENCE TO RELATED APPLICATIONS

This application is a U.S. National Phase Application under 35 U.S.C. §371 of International Application PCT/KR2011/001989, filed on Mar. 23, 2011, which claims the benefit of U.S. Provisional Application No. 61/316,390, filed on Mar. 23, 2010, and U.S. Provisional Application No. 61/451,564, filed on Mar. 10, 2011, the entire contents of which are hereby incorporated by reference in their entireties.

TECHNICAL FIELD

The present invention relates to an apparatus for processing an audio signal and method thereof. Although the present invention is suitable for a wide scope of applications, it is particularly suitable for encoding or decoding an audio signal.

BACKGROUND ART

Generally, in case that an audio signal, and more particularly, the audio signal has strong characteristics of a speech signal, linear predictive coding (LPC) is performed on the audio signal. A linear predictive coefficient generated by linear predictive coding is transmitted to a decoder. Subsequently, the decoder reconstructs the audio signal by performing linear predictive synthesis on the corresponding coefficient.

DISCLOSURE OF THE INVENTION

Technical Problem

Generally, a sampling rate is differently applied in accordance with a band of an audio signal. For instance, however, in order to encode an audio signal corresponding to a narrow band, it may cause a problem that a core having a low sampling rate is required. In order to encode an audio signal corresponding to a wide band, it may cause a problem that a core having a high sampling rate is separately required. Thus, the different cores differ from each other in the number of bits per frame and a bit rate.

Meanwhile, in case that a single sampling rate is applied irrespective of a narrow band signal or a wide band signal, since an order of a linear-predictive coefficient (or, the number of linear-predictive coefficients) is fixed, it may cause a problem that a case of a relative narrow band signal wastes bits unnecessarily.

Technical Solution

Accordingly, the present invention is directed to an apparatus for processing an audio signal and method thereof that substantially obviate one or more of the problems due to limitations and disadvantages of the related art. An object of the present invention is to provide an apparatus for processing an audio signal and method thereof, by which the same sampling rate can be applied irrespective of a bandwidth of the audio signal.

Another object of the present invention is to provide an apparatus for processing an audio signal and method thereof, by which an order of a linear-predictive coefficient can be adaptively changed in accordance with a bandwidth of an inputted audio signal.

Another object of the present invention is to provide an apparatus for processing an audio signal and method thereof, by which an order of a linear-predictive coefficient can be adaptively changed in accordance with a coding mode of an inputted audio signal.

A further object of the present invention is to provide an apparatus for processing an audio signal and method thereof, by which a $2^{nd}$ set of a $2^{nd}$ order (or, a $1^{st}$ set of a $1^{st}$ order for quantizing a $2^{nd}$ order) can be used for quantizing the $1^{st}$ set of the $1^{st}$ order using recurring properties of linear-predictive coefficients in quantizing linear-predictive coefficients (e.g., a coefficient of the $1^{st}$ set of the $1^{st}$ order, a coefficient of the $2^{nd}$ set of the $2^{nd}$ order) of different orders.

Advantageous Effects

Accordingly, the present invention provides the following effects and/or features.

First of all, the present invention applies the same sampling rate irrespective of a bandwidth of an inputted audio signal, thereby implementing an encoder and a decoder in a simple manner.

Secondly, the present invention extracts a linear-predictive coefficient of a relatively low order for a narrow band signal despite applying the same sampling rate irrespectively of a bandwidth, thereby saving bits having relatively low efficiency.

Thirdly, the present invention assigns bits saved in linear prediction to a coding of a linear predictive residual signal additionally, thereby maximizing bit efficiency.

BEST MODE

Figure 1:
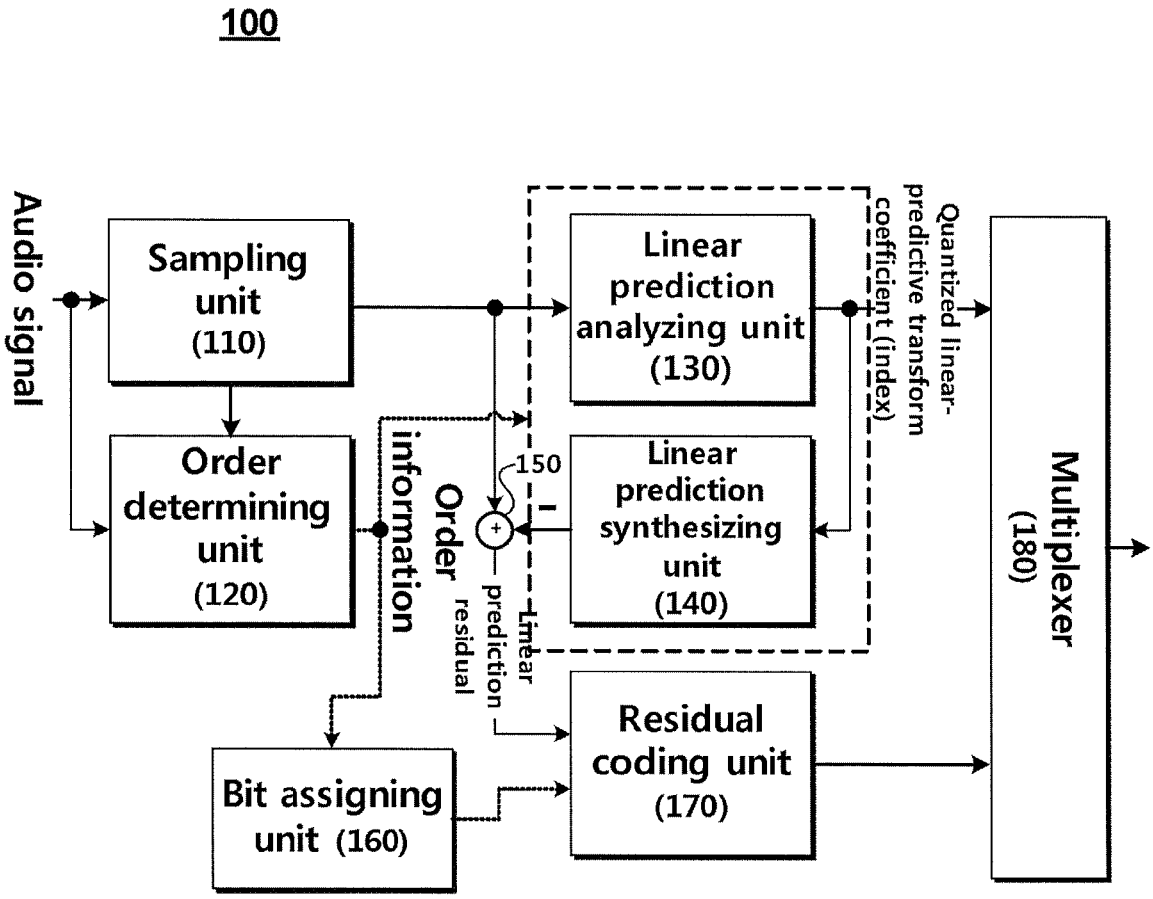
FIG. 1 is a block diagram of an encoder of an audio signal processing apparatus according to an embodiment of the present invention.

To achieve these and other advantages and in accordance with the purpose of the present invention, as embodied and broadly described, a method of processing an audio signal according to the present invention may include the steps of determining bandwidth information indicating that a current frame corresponds to which one among a plurality of bands including a $1^{st}$ band and a $2^{nd}$ band by performing a spectrum analysis on the current frame of the audio signal, determining order information corresponding to the current frame based on the bandwidth information, generating a $1^{st}$ set linear-predictive transform coefficient of a $1^{st}$ order by performing a linear-predictive analysis on the current frame, generating a $1^{st}$ set index by vector-quantizing the $1^{st}$ set linear-predictive transform coefficient, generating a $2^{nd}$ set linear-predictive transform coefficient of a $2^{nd}$ order in accordance with the order information by performing the linear-predictive analysis on the current frame, and if the $2^{nd}$ set linear-predictive transform coefficient is generated, performing a vector-quantization on a $2^{nd}$ set difference using the $1^{st}$ set index and the $2^{nd}$ set linear-predictive transform coefficient.

According to the present invention, a plurality of the bands further may include a $3^{rd}$ band and the method may further include the steps of generating a $3^{rd}$ set linear-predictive transform coefficient of a $3^{rd}$ order in accordance with the order information by performing the linear-predictive analysis on the current frame and performing quantization on a $3^{rd}$ set difference corresponding to a difference between an order-adjusted $2^{nd}$ set linear-predictive transform coefficient and the $3^{rd}$ set linear-predictive transform coefficient.

According to the present invention, if the bandwidth information indicates the $1^{st}$ band, the order information may be determined as a previously determined $1^{st}$ order. If the bandwidth information indicates the $2^{nd}$ band, the order information may be determined as a previously determined $2^{nd}$ order.

According to the present invention, the first order may be smaller than the $2^{nd}$ order.

According to the present invention, the method may further include the step of generating coding mode information indicating one of a plurality of modes including a $1^{st}$ mode and a $2^{nd}$ mode for the current frame, wherein the order information may be further determined based on the coding mode information.

According to the present invention, the order information determining step may include the steps of generating coding mode information indicating one of a plurality of modes including a $1^{st}$ mode and a $2^{nd}$ mode for the current frame, determining a temporary order based on the bandwidth information, determining a correction order in accordance with the coding mode information, and determining the order information based on the temporary order and the correction order.

To further achieve these and other advantages and in accordance with the purpose of the present invention, an apparatus for of processing an audio signal according to another embodiment of the present invention may include a bandwidth determining unit configured to determine bandwidth information indicating that a current frame corresponds to which one among a plurality of bands including a $1^{st}$ band and a $2^{nd}$ band by performing a spectrum analysis on the current frame of the audio signal, an order determining unit configured to determine order information corresponding to the current frame based on the bandwidth information, a linear-predictive coefficient generating/transforming unit configured to generate a $1^{st}$ set linear-predictive transform coefficient of a $1^{st}$ order by performing a linear-predictive analysis on the current frame, the linear-predictive coefficient generating/transforming unit configured to generate a $2^{nd}$ set linear-predictive transform coefficient of a $2^{nd}$ order in accordance with the order information, a $1^{st}$ quantizing unit configured to generate a $1^{st}$ set index by vector-quantizing the $1^{st}$ set linear-predictive transform coefficient, and a $2^{nd}$ quantizing unit, if the $2^{nd}$ set linear-predictive transform coefficient is generated, performing a vector-quantization on a $2^{nd}$ set difference using the $1^{st}$ set index and the $2^{nd}$ set linear-predictive transform coefficient.

According to the present invention, a plurality of the bands may further include a $3^{rd}$ band, the linear-predictive coefficient generating/transforming unit may further generate a $3^{rd}$ set linear-predictive transform coefficient of a $3^{rd}$ order in accordance with the order information by performing the linear-predictive analysis on the current frame, and the apparatus may further include a $3^{rd}$ quantizing unit configured to perform quantization on a $3^{rd}$ set difference corresponding to a difference between an order-adjusted $2^{nd}$ set linear-predictive transform coefficient and the $3^{rd}$ set linear-predictive transform coefficient.

According to the present invention, if the bandwidth information indicates the $1^{st}$ band, the order information may be determined as a previously determined $1^{st}$ order. If the bandwidth information indicates the $2^{nd}$ band, the order information may be determined as a previously determined $2^{nd}$ order.

According to the present invention, the first order may be smaller than the $2^{nd}$ order.

According to the present invention, the order determining unit may further include a mode determining unit configured to generate coding mode information indicating one of a plurality of modes including a $1^{st}$ mode and a $2^{nd}$ mode for the current frame and the order information may be further determined based on the coding mode information.

According to the present invention, the order determining unit may include a mode determining unit configured to generate coding mode information indicating one of a plurality of modes including a $1^{st}$ mode and a $2^{nd}$ mode for the current frame and an order generating unit configured to determine a temporary order based on the bandwidth information, the order generating unit configured to determine a correction order in accordance with the coding mode information, the order generating unit configured to determine the order information based on the temporary order and the correction order.

It is to be understood that both the foregoing general description and the following detailed description are exemplary and explanatory and are intended to provide further explanation of the invention as claimed.

Mode for Invention

Reference will now be made in detail to the preferred embodiments of the present invention, examples of which are illustrated in the accompanying drawings. First of all, terminologies or words used in this specification and claims are not construed as limited to the general or dictionary meanings and should be construed as the meanings and concepts matching the technical idea of the present invention based on the principle that an inventor is able to appropriately define the concepts of the terminologies to describe the inventor's invention in best way. The embodiment disclosed in this disclosure and configurations shown in the accompanying drawings are just one preferred embodiment and do not represent all technical idea of the present invention. Therefore, it is understood that the present invention covers the modifications and variations of this invention provided they come within the scope of the appended claims and their equivalents at the timing point of filing this application.

According to the present invention, terminologies in this specification can be construed as the following meanings and terminologies failing to be disclosed in this specification may be construed as the concepts matching the technical idea of the present invention. Specifically, 'coding' can be construed as 'encoding' or 'decoding' selectively and 'information' in this disclosure is the terminology that generally includes values, parameters, coefficients, elements and the like and its meaning can be construed as different occasionally, by which the present invention is non-limited.

In this disclosure, in a broad sense, an audio signal is conceptionally discriminated from a video signal and indicates any kind of signal that can be auditorily identified in case of playback. In a narrow sense, the audio signal means a signal having none or small quantity of speech characteristics. Audio signal of the present invention should be construed in a broad sense. And, the audio signal of the present invention can be understood as a narrow-sensed audio signal in case of being used in a manner of being discriminated from a speech signal.

Moreover, coding may indicate encoding only but may be conceptionally usable as including both encoding and decoding.

FIG. 1 is a block diagram of an encoder of an audio signal processing apparatus according to an embodiment of the present invention. Referring to FIG. 1, an encoder 100 includes an order determining unit 120 and a linear prediction analyzing unit 130 and may further include a sampling unit 110, a linear prediction synthesizing unit 140, an adder 150, a bit assigning unit 160, a residual coding unit 170 and a multiplexer 180.

Operations of the encoder 100 are schematically described as follows. First of all, in accordance with order information on a current frame, which is determined by the order determining unit 120, the linear prediction analyzing unit 130 generates a linear-predictive coefficient of a determined order. The respective components of the encoder 100 are described as follows.

First of all, the sampling unit 110 generates a digital signal by applying a predetermined sampling rate to an inputted audio signal. In doing so, the predetermined sampling rate may include 12.8 kHz, by which the present invention may be non-limited.

The order determining unit 120 determines order information of a current frame using an audio signal (and a sampled digital signal). In this case, the order information indicates the number of linear-predictive coefficients or an order of the linear-predictive coefficient. The order information may be determined in accordance with: 1) bandwidth information; 2) coding mode; and 3) bandwidth information and coding mode, which shall be described in detail with reference to FIG. 2 later.

The linear prediction analyzing unit 130 performs LPC (linear Prediction Coding) analysis on a current frame of an audio signal, thereby generating linear-predictive coefficients based on the order information generated by the order determining unit 120. The linear prediction analyzing unit 130 performs transform and quantization on the linear-predictive coefficients, thereby generating a quantized linear-predictive transform coefficient (index). According to the present invention, since total 4 embodiments of the linear prediction analyzing unit 130 are provided, the $1^{st}$ embodiment 130A, the $2^{nd}$ embodiment 130A', the $3^{rd}$ embodiment 130B and the $4^{th}$ embodiment 130C will be described with reference to FIG. 3, FIG. 7, FIG. 8 and FIG. 12, respectively.

The linear prediction synthesizing unit 140 generates a linear prediction synthesis signal using the quantized linear-predictive transform coefficient. In doing so, the order information may be usable for interpolation and a detailed configuration of the linear prediction synthesizing unit 140 will be described with reference to FIG. 13 later.

The adder 150 generates a linear prediction residual signal by subtracting the linear prediction synthesis signal from the audio signal. In particular, the adder may include a filter, by which the present invention may be non-limited.

The bit assigning unit 160 delivers control information for controlling bit assignment for the coding of the linear prediction residual to the residual coding unit 170 based on the order information. For instance, if an order is relatively low, the bit assigning unit 160 generates control information for increasing the bit number for coding of the linear prediction residual. For another instance, if an order is relatively high, the bit assigning unit 160 generates control information for decreasing the bit number for the linear prediction residual coding.

The residual coding unit 170 codes the linear prediction residual based on the control information generated by the bit assigning unit 160. The residual coding unit 170 may include a long-term prediction (LTP) unit (not shown in the drawing) configured to obtain a pitch gain and a pitch delay through a pitch search, and a codebook search unit (not shown in the drawing) configured to obtain a codebook index and a codebook gain by performing a codebook search on a pitch residual component that is a residual of the long-term prediction. For instance, in case that control information on a bit number increase is received, a bit assignment may be raised for at least one of a pitch gain, a pitch delay, a codebook index, a codebook gain and the like. For another instance, in case that control information on a bit number decrease is received, a bit assignment may be lowered for at least one of the above parameters.

Alternatively, the residual coding unit 170 may include a sinusoidal wave modeling unit (not shown in the drawing) and a frequency transform unit (not shown in the drawing) instead of the long-term prediction unit and the codebook search unit. In case that control information on a bit number increase is received, the sinusoidal wave modeling unit (not shown in the drawing) may be able to raise a bit number assignment to an amplitude phase frequency parameter. The frequency transform unit (not shown in the drawing) may operate by TCX or MDCH scheme. In case that control information on a bit number increase is received, the frequency transform unit may be able to increase the bit number assignment to frequency coefficient or normalization gain.

The multiplexer 180 generates at least one bitstream by multiplexing the quantized linear-predictive transform coefficient, the parameters (e.g., the pitch delay, etc.) corresponding to the outputs of the residual coding unit, and the like together. Meanwhile, the bandwidth information and/or coding mode information determined by the order determining unit 120 may be included in the bitstream. In particular, the bandwidth information may be included in a separate bitstream (e.g., a bitstream having a codec type and a bit rate included therein) instead of being included in the bitstream having the linear-predictive transform coefficient included therein.

In the following description, the configuration of the order determining unit 120 is explained in detail with reference to FIG. 2, the respective embodiments of the linear prediction analyzing unit 130 are explained in detail with reference to FIG. 3, FIG. 7, FIG. 8 and FIG. 12, and the configuration of the linear prediction synthesizing unit 140 is explained in detail with reference to FIG. 13.

Figure 2:
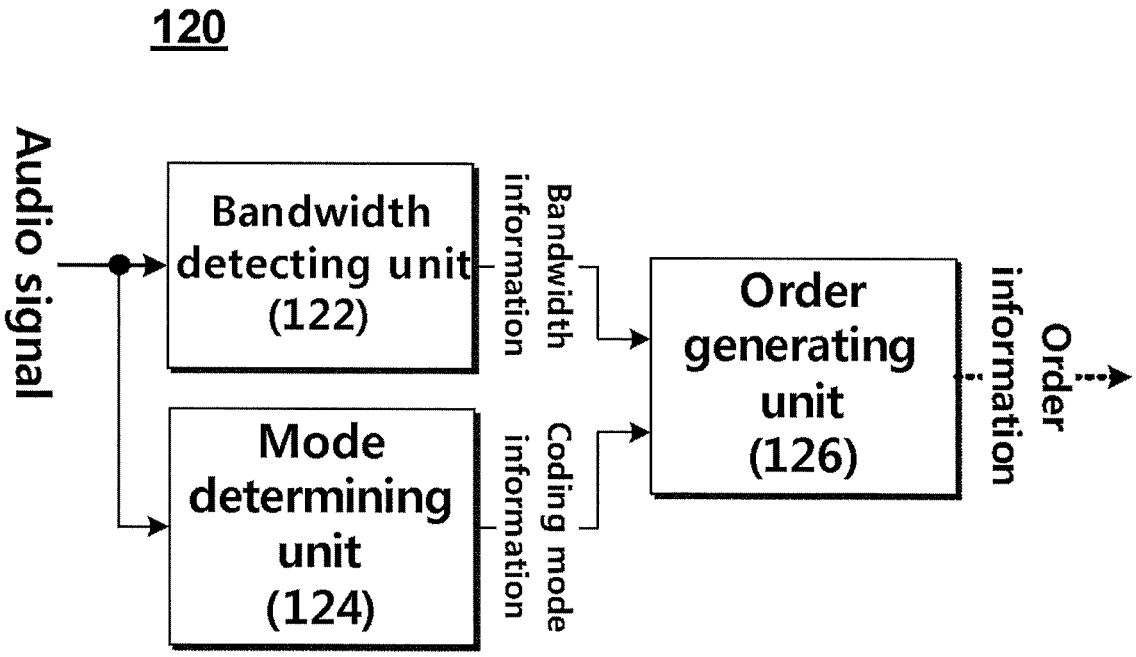
FIG. 2 is a detailed block diagram of an order determining unit 120 shown in FIG. 1 according to one embodiment.

FIG. 2 is a detailed block diagram of the order determining unit 120 shown in FIG. 1 according to one embodiment. Referring to FIG. 2, the order determining unit 120 may include at least one of a bandwidth detecting unit 122, a mode determining unit 124 and an order generating unit 126.

The bandwidth detecting unit 122 performs a spectrum analysis on an inputted audio signal (and a sampled signal) to detect that the inputted signal corresponds to which one of a plurality of bands including a $1^{st}$ band, a $2^{nd}$ band and a $3^{rd}$ band (optional) and then generates bandwidth information indicating a result of the detection. In doing so, FFT (fast Fourier transform) may be available for the spectrum analysis, by which the present invention may be non-limited.

In particular, the $1^{st}$ band may correspond to a narrow band (NB), the $2^{nd}$ band may correspond to a wide band (WB), and the $3^{rd}$ band may correspond to a super wide band (SWB). In more particular, the narrow band may correspond to 0~4 kHz, the wide band may correspond to 0~8 kHz, and the super wide band may correspond over 8 kHz or higher.

In case that the $1^{st}$ band corresponds to 0~4 kHz, since bandwidth information is band-limited, it may be able to determine whether a sampled audio signal corresponds to the $1^{st}$ band or the $2^{nd}$ band or higher in a manner of checking a spectrum between 4 kHz and 6.4 kHz for the sampled audio signal. If the $2^{nd}$ band or higher is determined, it may be able to determine the $2^{nd}$ band or the $3^{rd}$ band by checking a spectrum of an input signal of codec.

The bandwidth information determined by the bandwidth detecting unit 122 may be delivered to the order generating unit 126 or may be included in the bitstream in a manner of being delivered to the multiplexer 180 shown in FIG. 1 as well.

The mode determining unit 124 determines one coding mode suitable for the property of a current frame among a plurality of coding modes including a $1^{st}$ mode and a $2^{nd}$ mode, generates coding mode information indicating the determined coding mode, and then delivers the generated coding mode information to the order generating unit 126. A plurality of the coding modes may include total 4 coding modes. For instance, a plurality of the coding modes may include an un-voice coding mode suitable for a case of a strong un-voice property, a transition coding (TC) mode suitable for a case of a presence of a transition between a voiced sound and a voiceless sound, a voice coding (VC) mode suitable for a case of a strong voice property, a generic coding (GC) mode suitable for a general case and the like. And, the present invention may be non-limited by the number and/or properties of specific coding modes.

The coding mode information determined by the mode determining unit 124 may be delivered to the order generating unit 126 or may be included in the bitstream in a manner of being delivered to the multiplexer 180 shown in FIG. 1 as well.

The order generating unit 126 determines an order (or number) (e.g., a $1^{st}$ order, a $2^{nd}$ order, (and, a $3^{rd}$ order)) of a linear-predictive coefficient of a current frame using 1) bandwidth information or 2) coding mode information, or 3) bandwidth information and coding mode information and then generates order information.

1) In case of making a determination using the bandwidth information, if a $1^{st}$ band and 1 $2^{nd}$ band (and a $3^{rd}$ band) exist and the $1^{st}$ band is narrower than the $2^{nd}$ band (or the $3^{rd}$ band), a low order (e.g., a $1^{st}$ order) is determined for the case of the $1^{st}$ band. And, a high order (e.g., a $2^{nd}$ order) (or a highest order (e.g., a $3^{rd}$ order)) may be determined for the case of the $2^{nd}$ band (or the $3^{rd}$ band). For instance, if the $1^{st}$ band, the $2^{nd}$ band and the $3^{rd}$ band are the narrow band, the wide band and the super wide band, respectively, the order for the case of the $1^{st}$ band, the order for the case of the $2^{nd}$ band and the order for the case of the $3^{rd}$ band may be determined as 10, 16 and 20, respectively. Yet, the order of the present invention may be non-limited by a specific value. This is because linear-predictive coding can be more efficiently performed in a manner that an order should be increased in proportion to a bandwidth. On the contrary, in case of the narrow band, the same order of the super wide band or the wide band is not applied. Instead, by applying a lower order, an inter-band difference of quality can be reduced and efficiency of bit assignment can be raised.

2) In case of generating order information using coding mode information, orders may be raised in order of an un-voice coding mode, a transition coding mode, a generic coding mode and a voice coding mode. Since the voice property is weak in the un-voice coding mode, a voice model based linear-predictive coding scheme is not efficient. Hence a relatively low order (e.g., the $1^{st}$ order) is determined. In case of the voice mode, since the voice property is strong, the linear-predictive coding scheme is efficient. Hence, a relatively high order (e.g., the $2^{nd}$ order) is determined.

Meanwhile, when order information is generated using coding mode information, if various orders are determined for the same band, a low order and a high order shall be represented as $N1^{th}$ order and $N2^{th}$ order. The $N1^{th}$ order and $N2^{th}$ order shall be explained in the description of the $4^{th}$ embodiment 130C of the linear-predictive analyzing unit with reference to FIG. 12 later.

3) Meanwhile, when order information is determined using both bandwidth information and coding mode information, an order determined in advance according to the bandwidth information is set to a temporary order $N_{temp}$ (e.g., $1^{st}$ temporary order, $2^{nd}$ temporary order, $3^{rd}$ temporary order, etc.) and may be then determined by the following formula.

Un-voice coding mode:

$$\text{Order}(N_a)=\text{Temporary order}(N_{temp})+1^{st}\text{ correction order}(N_{m1})$$

Transition coding mode:

$$\text{Order}(N_b)=\text{Temporary order}(N_{temp})+2^{nd}\text{ correction order}(N_{m2})$$

Generic coding mode:

$$\text{Order}(N_c)=\text{Temporary order}(N_{temp})+3^{rd}\text{ correction order}(N_{m3})$$

Voice coding mode:

$$\text{Order}(N_d)=\text{Temporary order}(N_{temp})+4^{th}\text{ correction order}(N_{m4}), \quad \text{[Formula 1]}$$

where $N_{m1}$ to $N_{m4}$ are integers and $N_{m1}<N_{m2}<N_{m3}<N_{m4}$.

For instance, $N_{m1}$, $N_{m2}$, $N_{m3}$ and $N_{m4}$ may be set to −4, −2, 0 and +2, respectively, by which the present invention may be non-limited.

The above-determined order information may be delivered to the linear prediction analyzing unit 130 (and the linear prediction synthesizing unit 140) and the multiplexer 180, as shown in FIG. 1.

Figure 12:
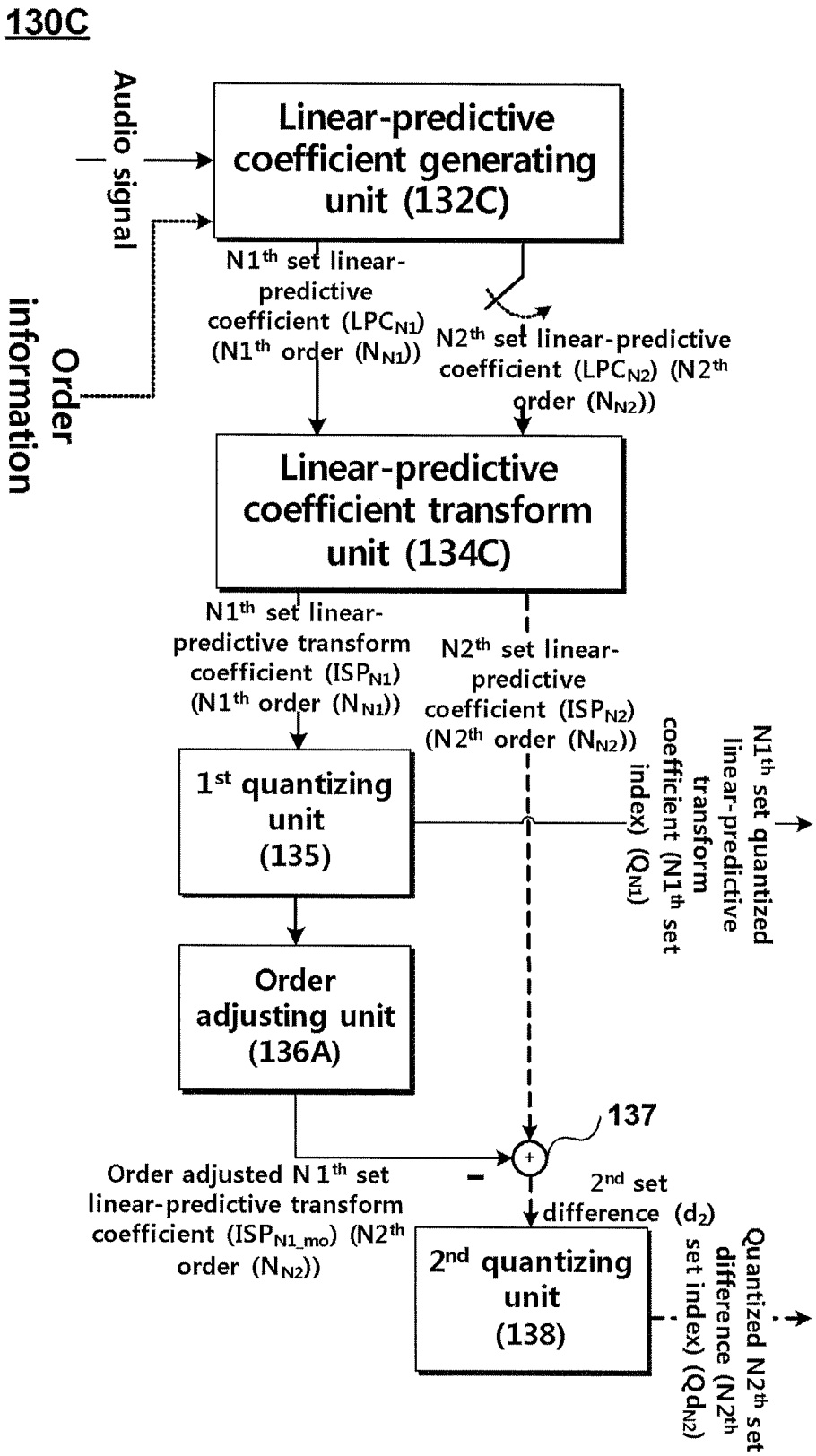
FIG. 12 is a detailed block diagram of a linear prediction analyzing unit 130 shown in FIG. 1 according to a $4^{th}$ embodiment (130C).

In the following description, the $1^{st}$ to $4^{th}$ embodiments of the linear prediction analyzing unit 130 shown in FIG. 1 are explained. The $1^{st}$ embodiment shown in FIG. 3 relates to using a $1^{st}$ set linear-predictive coefficient to quantize a $2^{nd}$ set linear-predictive coefficient [$1^{st}$ set reference embodiment], the $2^{nd}$ embodiment shown in FIG. 7 relates to an example of extending the $1^{st}$ embodiment to a $3^{rd}$ set [$1^{st}$ set reference extended embodiment], the $3^{rd}$ embodiment shown in FIG. 8 is an embodiment reverse to the $1^{st}$ embodiment and uses a $2^{nd}$ set linear-predictive coefficient to quantize a $1^{st}$ set linear-predictive coefficient [$2^{nd}$ set reference embodiment], and the $4^{th}$ embodiment shown in FIG. 12 is one example of a case that coefficients (N1 set, N2 set) of different orders are generated within the same band [$N1^{th}$ set reference embodiment].

Figure 3:
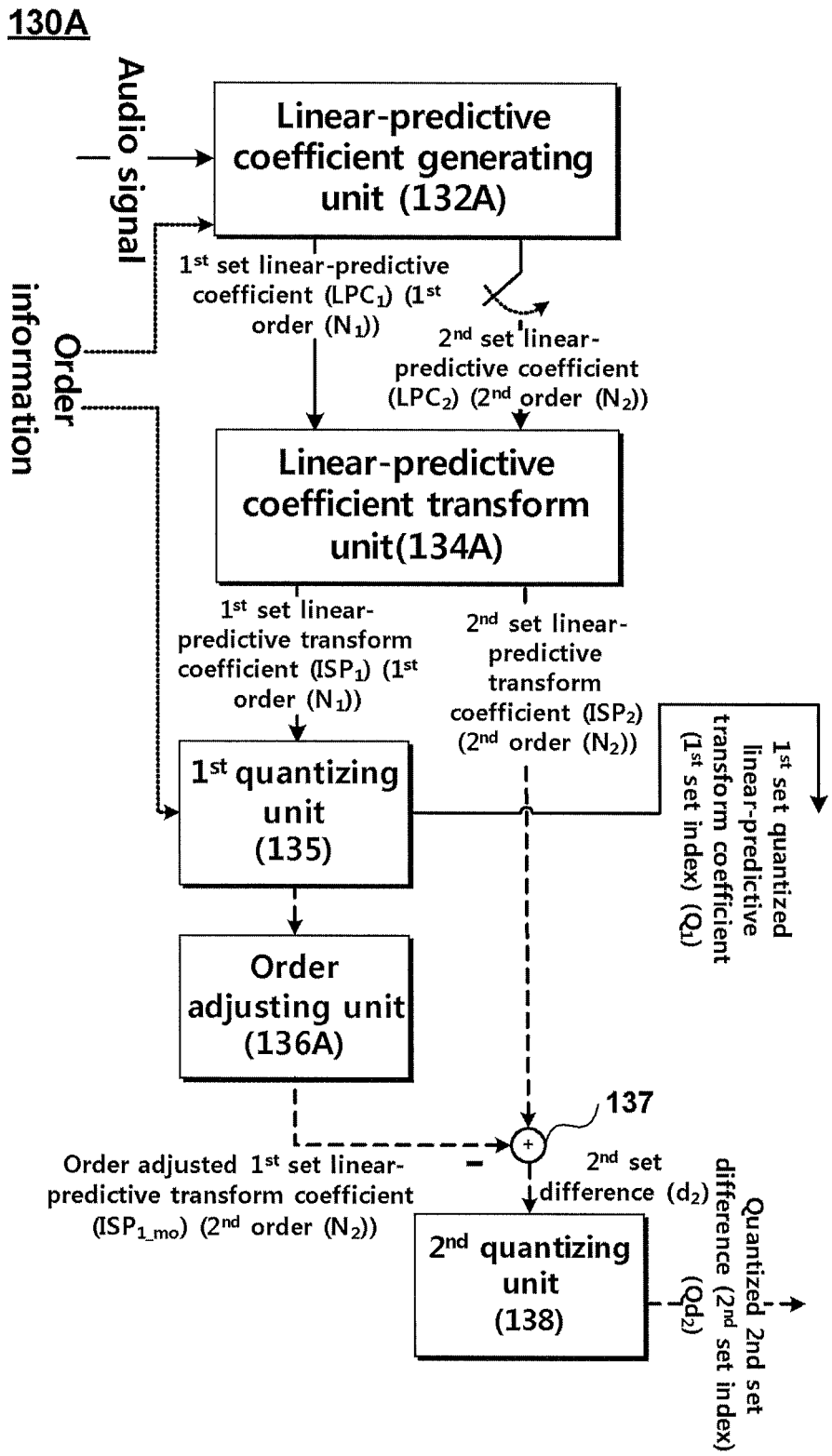
FIG. 3 is a detailed block diagram of a linear prediction analyzing unit 130 shown in FIG. 1 according to a $1^{st}$ embodiment (130A).
Figure 4:
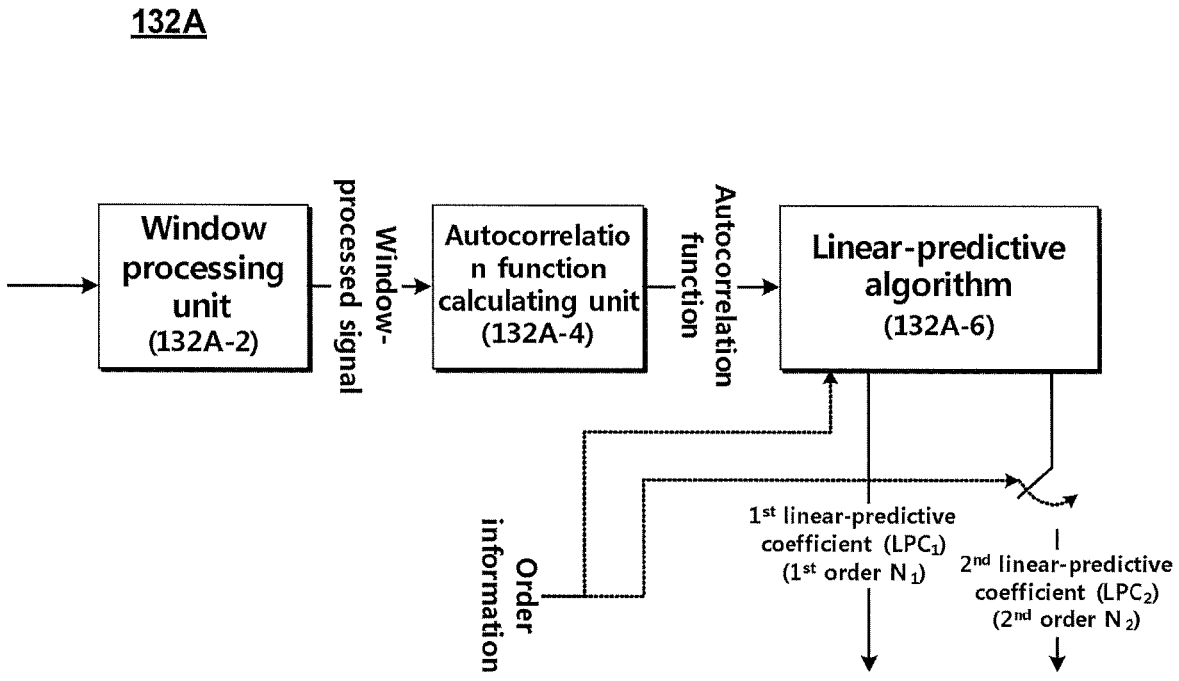
FIG. 4 is a detailed block diagram of a linear-predictive coefficient generating unit 132A shown in FIG. 3 according to an embodiment.
Figure 5:
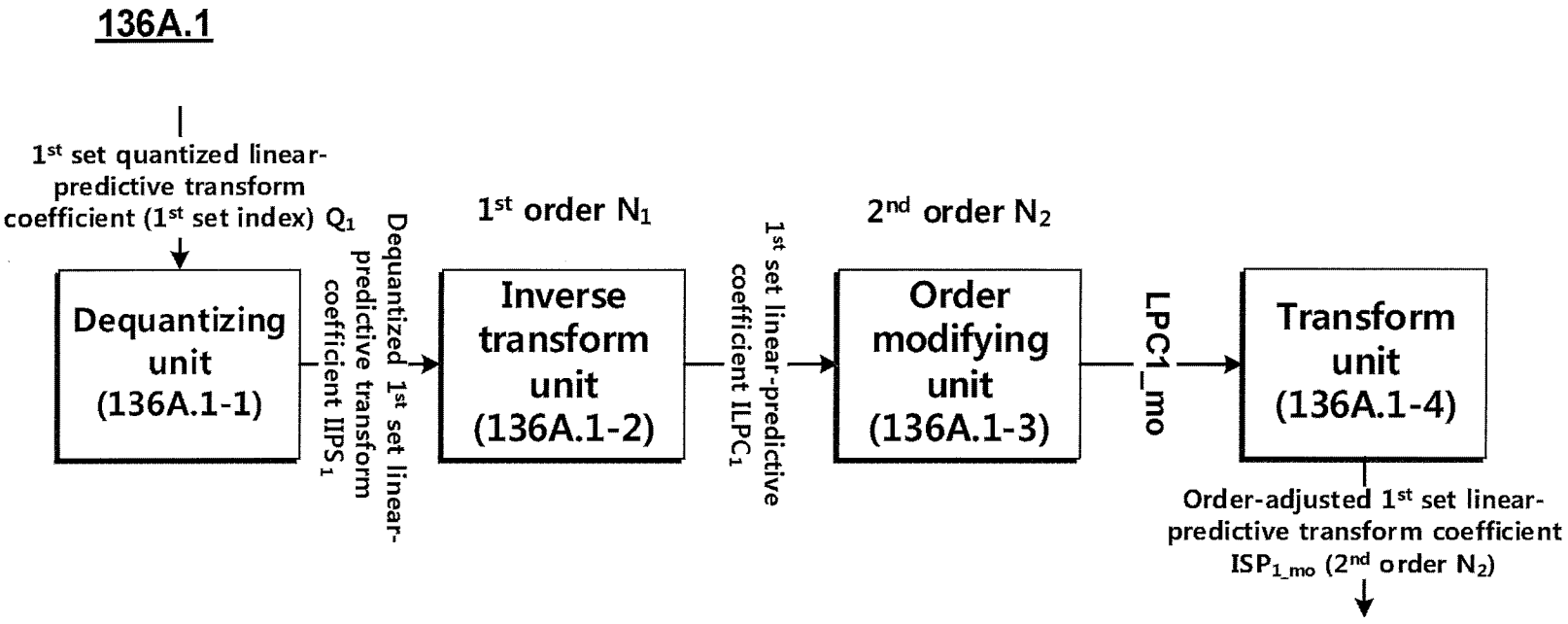
FIG. 5 is a detailed block diagram of an order adjusting unit 136A shown in FIG. 3 according to one embodiment.
Figure 6:
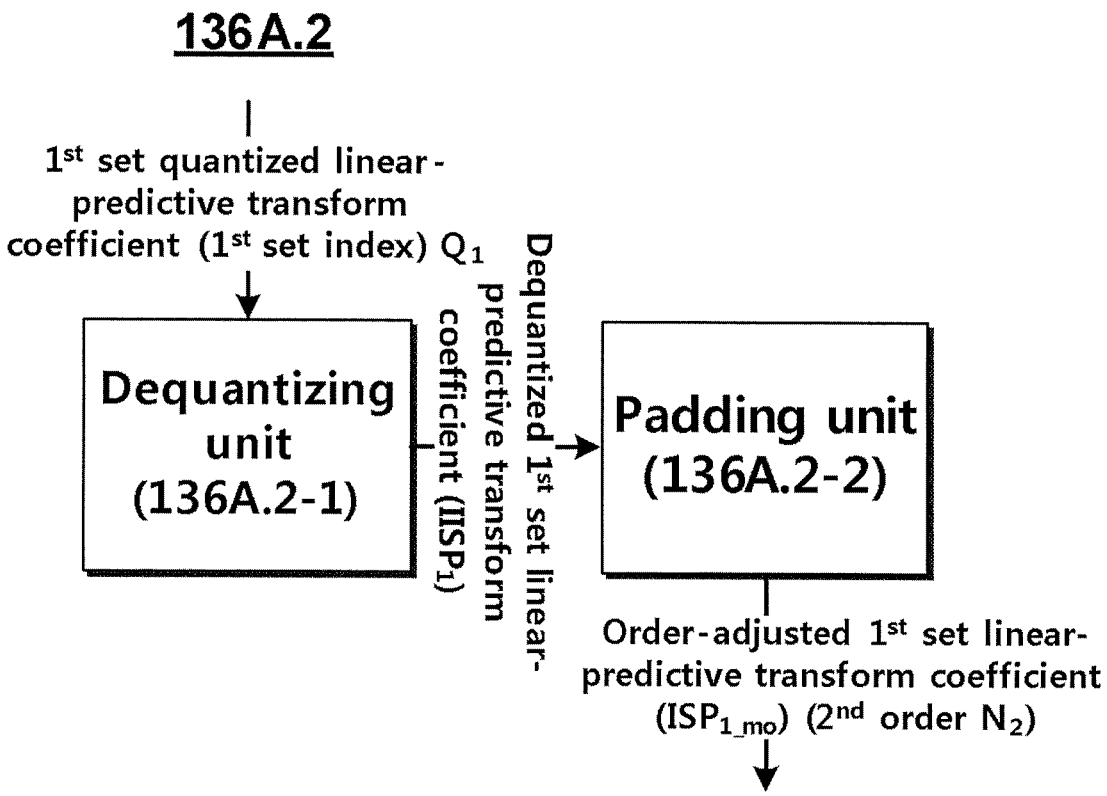
FIG. 6 is a detailed block diagram of an order adjusting unit 136A shown in FIG. 3 according to another embodiment.

FIGS. 3 to 6 are diagrams according to the $1^{st}$ embodiment of the linear prediction analyzing unit 130. FIG. 3 is a detailed block diagram of the linear prediction analyzing unit 130 shown in FIG. 1 according to the $1^{st}$ embodiment (130A). FIG. 4 is a detailed block diagram of a linear-predictive coefficient generating unit 132A shown in FIG. 3 according to an embodiment. FIG. 5 is a detailed block diagram of an order adjusting unit 136A shown in FIG. 3 according to one embodiment. FIG. 6 is a detailed block diagram of an order adjusting unit 136A shown in FIG. 3 according to another embodiment. In the following description, the $1^{st}$ embodiment is explained with reference to FIGS. 3 to 6 and the $2^{nd}$ to $4^{th}$ embodiments are then explained with reference to FIG. 7, FIG. 8 and the like.

Referring to FIG. 3, a linear prediction analyzing unit 130A according to the first embodiment may include a linear-predictive coefficient generating unit 132A, a linear-predictive coefficient transform unit 134A, a $1^{st}$ quantizing unit 135, an order adjusting unit 136A and a $2^{nd}$ quantizing unit 138.

When a $1^{st}$ set linear-predictive coefficient $LPC_1$ corresponding to a $1^{st}$ order N1 and a $2^{nd}$ set linear-predictive coefficient $LPC_2$ corresponding to a $2^{nd}$ order N2 exist, if the $1^{st}$ order is smaller than the $2^{nd}$ order, as mentioned in the foregoing description, the $1^{st}$ embodiment is the embodiment with reference to a $1^{st}$ set. In particular, if the $1^{st}$ set is generated, $1^{st}$ set coefficients are quantized only. If the $2^{nd}$ set is generated as well, the $2^{nd}$ set is quantized using the $1^{st}$ set.

The linear-predictive coefficient generating unit 132A generates a linear-predictive coefficient of an order corresponding to order information by performing a linear-predictive analysis on an audio signal. In particular, if the order information indicates the $1^{st}$ order $N_1$, the linear-predictive coefficient generating unit 132A generates the $1^{st}$ set linear-predictive coefficient $LPC_1$ of the $1^{st}$ order $N_1$ only. If the order information indicates the $2^{nd}$ order $N_2$, the linear-predictive coefficient generating unit 132A generates both of the $1^{st}$ set linear-predictive coefficient $LPC_1$ of the $1^{st}$ order $N_1$ and the $2^{nd}$ set linear-predictive coefficient $LPC_2$ of the $2^{nd}$ order $N_2$. In this case, the $1^{st}$ order/number is the number smaller than the $2^{nd}$ order/number. For instance, if the $1^{st}$ order and the $2^{nd}$ order are set to 10 and 16, respectively, 10 linear-predictive coefficients become the $1^{st}$ set $LPC_1$ and 16 linear-predictive coefficients become the $2^{nd}$ set $LPC_2$. In this case, the $1^{st}$ set $LPC_1$ is characterized in that its linear-predictive coefficients are almost similar to the values of $1^{st}$ to $10^{th}$ coefficients among the 16 linear-predictive coefficients of the $2^{nd}$ set $LPC_2$. Based on such characteristic, the $1^{st}$ set is usable to quantize the $2^{nd}$ set.

A detailed configuration of the linear-predictive coefficient generating unit 132A is described with reference to FIG. 4 as follows.

Referring to FIG. 4, the linear-predictive coefficient generating unit 132A includes a linear-predictive algorithm 132A-6 and may further include a window processing unit 132A-2 and an autocorrelation function calculating unit 132A-4.

The window processing unit 132A-2 applies a window for frame processing to an audio signal received from the sampling unit 110.

The autocorrelation function calculating unit 132A-4 calculates an autocorrelation function of the window-processed signal for a linear-predictive analysis.

Meanwhile, a basic idea of a linear prediction coding model is to approximate a linear combination of the past p voice signals at a given timing point n, which can be represented as the following formula.

$$S(n) \approx \alpha_1 S(n-1) + \alpha_2 S(n-2) + \ldots + \alpha_p S(n-p) \quad \text{[Formula 2]}$$

In Formula 2, the $\alpha_i$ indicates a linear-predictive coefficient, the n indicates a frame index, and the p indicates a linear-predictive order.

As a method of finding a solution ($\alpha_p$) of linear-predictive coding, there may be an autocorrelation method or a covariance method. In particular, an autocorrelation function relates to a general method of finding the solution using a recursive loop in an audio coding system and is more efficient than a direct calculation.

The autocorrelation function calculating unit 132A-4 calculates an autocorrelation function R(k).

The linear-predictive algorithm 132A-6 generates a linear-predictive coefficient corresponding to order information using the autocorrelation function R(k). This may correspond to a process for finding a solution of the following formula. In doing so, Levinson-Durbin algorithm may apply thereto.

$$\sum_{k=1}^{p} \alpha_k R[|i-k|] = R[i] \quad 1 \le i \le p: \quad P \text{ equations} \quad \text{[Formula 3]}$$

In Formula 3, $\alpha_k$ and R[ ] indicate a linear-predictive coefficient and an autocorrelation function, respectively.

In order to find solutions of the p equations, the following (P+1) equations are generated using a minimum mean-squared prediction error equation.

$$\begin{bmatrix} R[0] & R[1] & R[2] & \ldots & R[i-1] \\ R[1] & R[0] & R[1] & \ldots & R[i-2] \\ R[2] & R[1] & R[0] & \ldots & R[i-3] \\ \vdots & \vdots & \vdots & \vdots & \vdots \\ R[i-1] & R[i-2] & R[i-3] & \ldots & R[0] \end{bmatrix} \quad \text{[Formula 4]}$$

$$\begin{bmatrix} 1 \\ -\alpha_1^{(i-1)} \\ -\alpha_2^{(i-1)} \\ \vdots \\ -\alpha_{i-1}^{(i-1)} \end{bmatrix} = \begin{bmatrix} E^{(i-1)} \\ 0 \\ 0 \\ \vdots \\ 0 \end{bmatrix} : \quad (P+1) \text{ equations}$$

In Formula 4, $$R[0] - \sum_{k=1}^{p} \alpha_k R[k] = E^{(p)}$$

indicates a minimum mean-squared prediction error equation.

In order to find solutions of the (P+1) equations through the recursive loop, as mentioned in the foregoing description, Levinson-Durbin algorithm is used as follows.

[Formula 5]

$$\varepsilon^{(0)} = R[0]$$

for $i = 1, 2, \ldots, p$ $$k_i = \left(R[i] - \sum_{j=1}^{i-1} \alpha_j^{(i-1)} R[i-j]\right) \Big/ \varepsilon^{(i-1)}$$

$$\alpha_i^{(i)} = k_i$$

if $i > 1$ then for $j = 1, 2, \ldots, i-1$ $$\alpha_j^{(i)} = \alpha_j^{(i-1)} - k_i \alpha_{i-j}^{(i-1)}$$

end $$\varepsilon^{(i)} = (1 - k_i^2)\varepsilon^{(i-1)}$$

end $$\alpha_j = \alpha_i^{(p)} \quad j = 1, 2, \ldots, p$$

The linear-predictive algorithm 132A-6 generates linear-predictive coefficients through the above-mentioned process. As mentioned in the foregoing description, the linear-predictive algorithm 132A-6 generates the $1^{st}$ set linear-predictive coefficient LPC1 in case of the $1^{st}$ order $N_1$ or both of the $1^{st}$ set linear-predictive coefficient $LPC_1$ and the $2^{nd}$ set linear-predictive coefficient $LPC_2$ of the $2^{nd}$ order in case of the $2^{nd}$ order $N_2$. In particular, the $1^{st}$ set $LPC_1$ is generated irrespective of an order. And, whether to generate the $2^{nd}$ set $LPC_2$ of the $2^{nd}$ order is adaptively determined in accordance with the order information (i.e., the $1^{st}$ order or the $2^{nd}$ order).

Alternatively, the switching for whether to generate the $2^{nd}$ set may be performed not by the linear-predictive coefficient generating unit 132A but by the linear-predictive coefficient transform unit 134A shown in FIG. 3. In this case, irrespective of the order information, the linear-predictive coefficient generating unit 132A generates both of the $1^{st}$ set and the $2^{nd}$ set. Irrespective of the order, the linear-predictive coefficient transform unit 134A transforms the $1^{st}$ set and then determines whether to transform the $2^{nd}$ set in accordance with the order information.

In the following description, since the switching is explained as performed by the linear-predictive coefficient generating unit 132A for convenience, it may be achieved by the linear-predictive coefficient transform unit 134A. This may identically apply to the linear prediction analyzing units according to the $2^{nd}$ to $4^{th}$ embodiments and its details shall be omitted from the following description.

In the above description, the detailed configuration of the linear-predictive coefficient generating unit 132A is explained. In the following description, the rest of the components of the linear prediction analyzing unit 130A are explained with reference to FIG. 3.

The linear-predictive coefficient generating unit 132A generates a $1^{st}$ set linear-predictive transform coefficient $ISP_1$ of the $1^{st}$ order $N_1$ by transforming the $1^{st}$ set linear-predictive coefficient $LPC_1$ generated by the linear-predictive coefficient generating unit 132A. If the $2^{nd}$ set linear-predictive coefficient $LPC_2$ is generated, the linear-predictive coefficient transform unit 134A generates a $2^{nd}$ set linear-predictive transform coefficient $ISP_2$ by transforming the $2^{nd}$ set as well.

Since the formerly obtained linear-predictive coefficient has a large dynamic range, it may need to be quantized with a smaller number of bits. Since the linear-predictive coefficient is vulnerable to quantization error, it may need to be transformed into a linear-predictive transform coefficient strong against the quantization error. In this case, the linear-predictive transform coefficient may include one of LSP (Line Spectral Pairs), ISP (Immittance Spectral Pairs), LSF (Line Spectrum Frequency) and ISF (Immittance Spectral Frequency), by which the present invention may be non-limited. In this case, the ISF may be represented as the following formula.

[Formula 6]

$$f_i = \frac{f_s}{2\pi}\arccos(q_i), \quad i = 1, \ldots, 15$$

$$= \frac{f_s}{4\pi}\arccos(q_i), \quad i = 16$$

In Formula 6, the $\alpha_i$ indicates a linear-predictive coefficient, the $f_i$ indicates a frequency range of [0.6400 Hz] of ISF, and the '$f_s$=12800' indicates a sampling frequency.

The $1^{st}$ quantizing unit 135 generates a $1^{st}$ set quantized linear-predictive transform coefficient (hereinafter named a $1^{st}$ index) $Q_1$ by quantizing the $1^{st}$ set linear-predictive transform coefficient $ISP_1$ and then outputs the $1^{st}$ index $Q_1$ to the multiplexer 180. Meanwhile, if the order information includes the $2^{nd}$ order, the $1^{st}$ index $Q_1$ is delivered to the order adjusting unit 136A. If an order of a current frame is a $1^{st}$ order, the corresponding process may end in a manner of quantizing a $1^{st}$ set of the $1^{st}$ order. Yet, if an order of a current frame is a $2^{nd}$ order, the $1^{st}$ should be used for quantization of a $2^{nd}$ set.

The order adjusting unit 136A generates a $1^{st}$ set linear-predictive transform coefficient $ISP_{1_mo}$ of the $2^{nd}$ order $N_2$ by adjusting the order of the $1^{st}$ set index $Q_1$ of the $1^{st}$ order $N_1$. A detailed configuration of one embodiment 136A.1 of the order adjusting unit 136A is shown in FIG. 5 and a detailed configuration of another embodiment 136A.2 is shown in FIG. 6.

Referring to FIG. 5, an order adjusting unit 136A.1 according to one embodiment includes a dequantizing unit 136A.1-1, an inverse transform unit 136A.1-2, an order modifying unit 136A.1-3 and a transform unit 136A.1-4.

The dequantizing unit 136A.1-1 generates a $1^{st}$ set linear-predictive transform coefficient $IISP_1$ by dequantizing the $1^{st}$ set index $Q_1$. The inverse transform unit 126A.1-2 generates a $1^{st}$ set linear-predictive coefficient ILPC1 by inverse-transforming the linear-predictive transform coefficient $IISP_1$. Thus, the dequantization and the inverse transform are performed to modify an order in a linear-predictive coefficient domain (i.e., time domain). Meanwhile, there may be an embodiment for modifying an order in a linear-predictive transform coefficient domain (i.e., frequency domain). In this case, the inverse transform unit and the transform unit are excluded and the order modifying unit operates in frequency domain only. Although the operation in time domain is described only in this specification, it is a matter of course that the operation in frequency domain is available as well.

The order modifying unit 136A.1-3 estimates a $1^{st}$ set linear-predictive coefficient $ILPC_{1_mo}$ of the $2^{nd}$ order $N_2$ from the $1^{st}$ set linear-predictive coefficient $ILPC_1$ of the $1^{st}$ order $N_1$. For instance, the order modifying unit 136A.1-3 estimates 16 linear-predictive coefficients using 10 linear-predictive coefficients. In doing so, Levinson-Durbin algorithm or a recursive method of lattice structure may be usable.

The transform unit 136A.1-4 generates an order-adjusted linear-predictive transform coefficient $ISP_{1_mo}$ by transforming the order-adjusted $1^{st}$ set linear-predictive coefficient $ILPC_{1_mo}$.

Thus, the order adjusting unit 136.A1 according to one embodiment of the present invention relates to a method of adjusting an order by an estimation process using algorithm. On the other hand, an order adjusting unit 136.A2 according to another embodiment mentioned in the following description relates to a method of randomly changing an order only.

Referring to FIG. 6, an order adjusting unit 136.A2 according to another embodiment includes a dequantizing unit 136.A2-1 like that of one embodiment. Meanwhile, a padding unit 136A.2-2 generates a $1^{st}$ set linear-predictive transform coefficient $ISP_{1_mo}$, of which format is adjusted into the $2^{nd}$ order $N_2$ only, by padding position corresponding to an order difference ($N_2-N_1$) with 0 for the dequantized $1^{st}$ set linear-predictive transform coefficient $IISP_1$.

Thus, referring now to FIG. 3, the adder 137 generates a $2^{nd}$ set difference $d_2$ by subtracting the order-adjusted $1^{st}$ set linear-predictive transform coefficient $ISP_{1_mo}$ from the $2^{nd}$ set linear-predictive transform coefficient $ISP_2$. In this case, since the $1^{st}$ set linear-predictive transform coefficient $ISP_{1_mo}$ corresponds to a prediction of the $2^{nd}$ set linear-predictive transform coefficient $ISP_2$, the rest of the difference is quantized by the $2^{nd}$ quantizing unit 138 and the quantized $2^{nd}$ set difference (i.e., $2^{nd}$ set index) $Qd_2$ is then outputted to the multiplexer.

Figure 7:
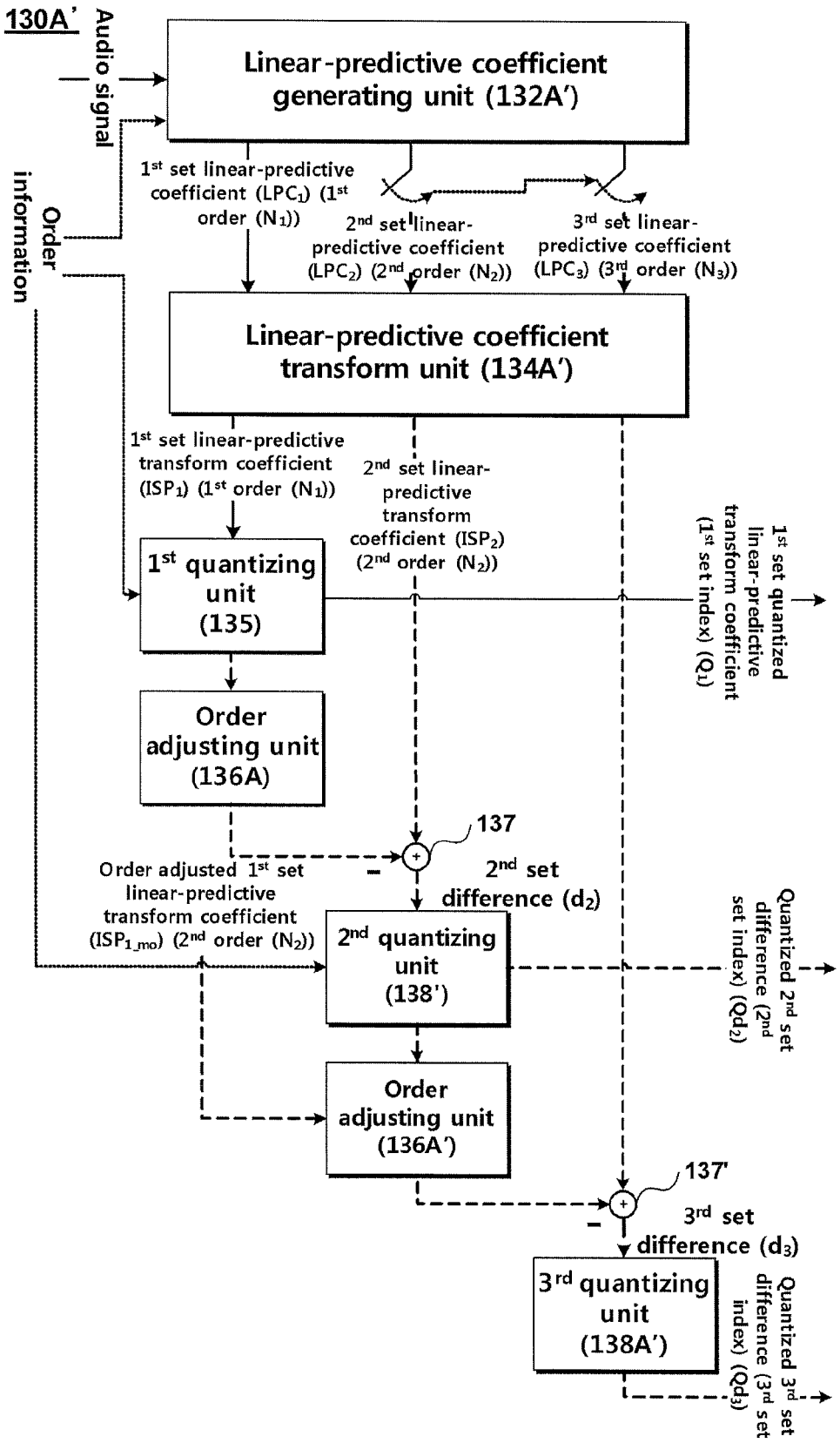
FIG. 7 is a detailed block diagram of a linear prediction analyzing unit 130 shown in FIG. 1 according to a $2^{nd}$ embodiment (130A').
Figure 8:
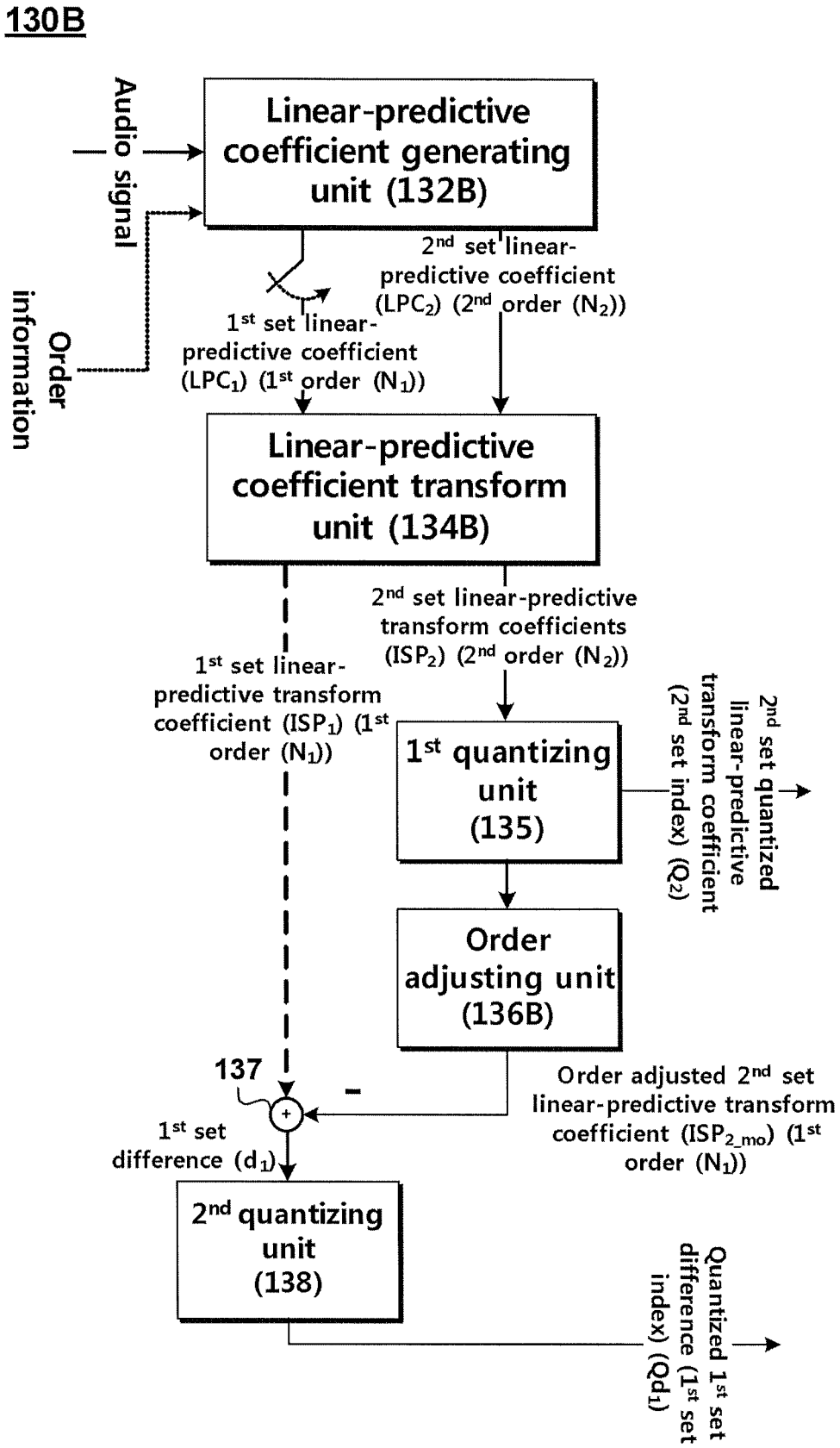
FIG. 8 is a detailed block diagram of a linear prediction analyzing unit 130 shown in FIG. 1 according to a $3^{rd}$ embodiment (130B).

FIG. 7 is a detailed block diagram of a linear prediction analyzing unit 130 shown in FIG. 1 according to a $2^{nd}$ embodiment (130A'). As mentioned in the foregoing description, the $2^{nd}$ embodiment shown in FIG. 7 includes the example of extending the $1^{st}$ embodiment up to a $3^{rd}$ set. In this case, a $1^{st}$ order $N_1$, a $2^{nd}$ order $N_2$ and a $3^{rd}$ order $N_3$ increase in order ($N_1<N_2<N_3$). In doing so, a linear-predictive coefficient generating unit 132A' always generates a $1^{st}$ set linear-predictive coefficient $LPC_1$ irrespective of an order. If the order is the $2^{nd}$ order $N_2$, the linear-predictive coefficient generating unit 132A' further generates a $2^{nd}$ linear-predictive coefficient $LPC_2$. If the order is the $3^{rd}$ order N3, the linear-predictive coefficient generating unit 132A' further generates a $2^{nd}$ set linear-predictive coefficient $LPC_2$ and a $3^{rd}$ linear-predictive coefficient $LPC_3$.

The linear-predictive coefficient transform unit 134A' transforms the linear-predictive coefficient delivered from the linear-predictive coefficient generating unit 132A'. In particular, since the $1^{st}$ set coefficient is delivered only in case of the $1^{st}$ order, the linear-predictive coefficient transform unit 134A' generates the $1^{st}$ set transform coefficient $ISP_1$. In case of the $2^{nd}$ order, the linear-predictive coefficient transform unit 134A' generates the $1^{st}$ set transform coefficient ISP1 and the $2^{nd}$ set transform coefficient $ISP_2$. In case of the $3^{rd}$ order, the linear-predictive coefficient transform unit 134A' generates the $1^{st}$ set transform coefficient $ISP_1$, the $2^{nd}$ set transform coefficient $ISP_2$ and the $3^{rd}$ set transform coefficient $ISP_3$.

Subsequently, a $1^{st}$ quantizing unit 135, an order adjusting unit 136A, a $1^{st}$ adder 137 and a $2^{nd}$ quantizing unit 138' perform the same operations of the former $1^{st}$ quantizing unit 135, adder 137 and order adjusting unit 136A shown in FIG. 3. Yet, if the order is the $3^{rd}$ order based on the order information, the $2^{nd}$ quantizing unit 138' delivers the $2^{nd}$ set index $Qd_2$ to the order adjusting unit 136A' as well.

This order adjusting unit 136A' is almost identical to the former order adjusting unit 136A but differs from the former order adjusting unit 136A in changing the $2^{nd}$ order into the $3^{rd}$ order instead of changing the $1^{st}$ order into the $2^{nd}$ order. Moreover, the latter order adjusting unit 136A' differs from the former order adjusting unit 136A in dequantizing the $2^{nd}$ set difference value, adding the order-adjusted $1^{st}$ set coefficient $ISP_{1mo}$ thereto, and then performs an order adjustment on the corresponding result.

The $2^{nd}$ adder 137' generates a $3^{rd}$ set difference $d_3$ by subtracting the order-adjusted $2^{nd}$ set linear-predictive transform coefficient $ISP_{2_mo}$ from the $3^{rd}$ set linear-predictive transform coefficient $ISP_3$. And, the $3^{rd}$ quantizing unit 138A' generates a quantized $3^{rd}$ set difference (i.e., a $3^{rd}$ set index) $Qd_3$ by performing vector quantization on the $3^{rd}$ difference $d_3$.

In the following description, the $3^{rd}$ embodiment 130B of the linear prediction analyzing unit 130 shown in FIG. 1 shall be explained with reference to FIGS. 8 to 11. As mentioned in the foregoing description, the $3^{rd}$ embodiment is based on the $2^{nd}$ set, whereas the $1^{st}$ embodiment is based on the $1^{st}$ set. In particular, according to the $3^{rd}$ embodiment, a $2^{nd}$ set linear-predictive coefficient is generated irrespective of order information and a $1^{st}$ set linear-predictive coefficient is quantized using the $2^{nd}$ set. The respective components of the $3^{rd}$ embodiment are described in detail as follows.

First of all, a $3^{rd}$ embodiment 130B of the linear prediction analyzing unit 130 includes a linear-predictive coefficient generating unit 132B, a linear-predictive coefficient transform unit 134B, a $1^{st}$ quantizing unit 135, an order adjusting unit 136B and a $2^{nd}$ quantizing unit 137.

The linear-predictive coefficient generating unit 123B generates a linear-predictive coefficient of an order corresponding to order information by performing a linear-predictive analysis on an audio signal. Since a $1^{st}$ order is a reference unlike the $1^{st}$ embodiment, if the order information includes a $2^{nd}$ order $N_2$, a $2^{nd}$ set linear-predictive coefficient $LPC_2$ of the $2^{nd}$ order $N_2$ is generated only. If the order information includes the $1^{st}$ order $N_1$, both of the $1^{st}$ set linear-predictive coefficient $LPC_1$ of the $1^{st}$ order $N_1$ and the $2^{nd}$ set linear-predictive coefficient $LPC_2$ of the $2^{nd}$ order $N_2$ are generated. Like the $1^{st}$ embodiment 132A, the $1^{st}$ order/number is the number smaller than the $2^{nd}$ order/number. For instance, if the $1^{st}$ order and the $2^{nd}$ order are set to 10 and 16, respectively, 10 linear-predictive coefficients become the $1^{st}$ set $LPC_1$ and 16 linear-predictive coefficients become the $2^{nd}$ set $LPC_2$. In this case, the 10 coefficients of the $1^{st}$ set $LPC_1$ are characterized in being almost similar to the values of $1^{st}$ to $10^{th}$ coefficients among the 16 linear-predictive coefficients of the $2^{nd}$ set $LPC_2$. Based on such characteristic, the $2^{nd}$ set is usable to quantize the $1^{st}$ set.

Figure 9:
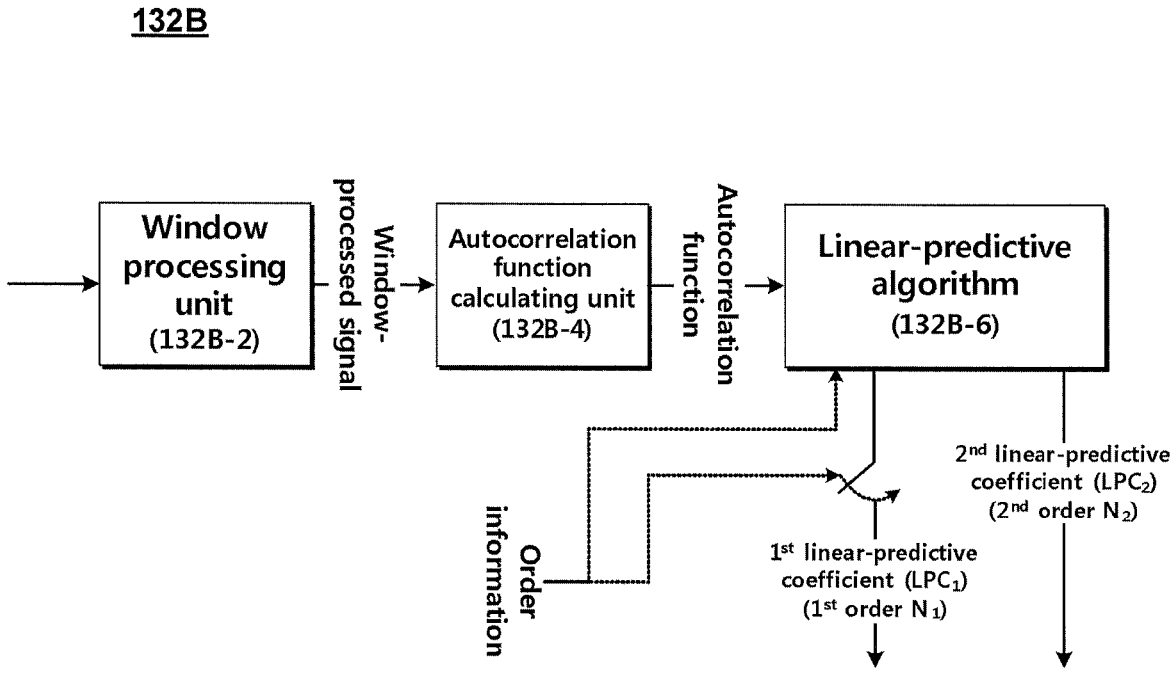
FIG. 9 is a detailed block diagram of a linear-predictive coefficient generating unit 132B shown in FIG. 8 according to an embodiment.

FIG. 9 is a detailed block diagram of the linear-predictive coefficient generating unit 132B shown in FIG. 8 according to an embodiment. This is as good as the detailed configuration of the $1^{st}$ embodiment 132A shown in FIG. 4. In particular, a window processing unit 132B-2 and an autocorrelation function calculating unit 132B-4 perform the same functions of the former components 132A-2 and 134A-4 of the same names mentioned in the foregoing description of the $1^{st}$ embodiment and their details shall be omitted from the following description. A linear-predictive algorithm 132B-6 is identical to the former linear-predictive algorithm 132A-6 of the $1^{st}$ embodiment but differs from the former linear-predictive algorithm 132A-6 in being based on the $2^{nd}$ set. In particular, a $2^{nd}$ set coefficient $ISP_2$ is generated irrespective of order information. A $1^{st}$ set coefficient $LPC_1$ is generated if order information includes a $1^{st}$ order. The $1^{st}$ set coefficient LPC1 is not generated if the order information includes a $2^{nd}$ order.

Referring now to FIG. 4, the linear-predictive coefficient transform unit 134B performs the function almost similar to that of the former linear-predictive coefficient transform unit 134 of the $1^{st}$ embodiment. Yet, the linear-predictive coefficient transform unit 134B differs from the former linear-predictive coefficient transform unit 134 of the $1^{st}$ embodiment in generating the $2^{nd}$ set linear-predictive transform coefficient $ISP_2$ by transforming the $2^{nd}$ set linear-predictive coefficient $LPC_2$ and generating the $1^{st}$ set linear-predictive transform coefficient $ISP_1$ by transforming the $1^{st}$ set coefficient $LPC_1$ only if receiving the $1^{st}$ set coefficient $LPC_1$.

As mentioned in the foregoing description of the $1^{st}$ embodiment, the linear-predictive coefficient generating unit 132B generates both of the $1^{st}$ set linear-predictive coefficient $LPC_1$ and the $2^{nd}$ set linear-predictive coefficient $LPC_2$ irrespective of the order information and the linear-predictive coefficient transform unit 134 may be able to transform the coefficients in accordance with the order information selectively [not shown in the drawing]. In particular, in case of the $2^{nd}$ order, the linear-predictive coefficient transform unit 134B transforms the $2^{nd}$ set coefficient only. In case of the $1^{st}$ order, the linear-predictive coefficient transform unit 134B transforms both of the $1^{st}$ set coefficient and the $2^{nd}$ set coefficient.

Meanwhile, the $1^{st}$ quantizing unit 135 generates a $2^{nd}$ set quantized linear-predictive transform coefficient (i.e., a $2^{nd}$ set index) Q2 by vector-quantizing the $2^{nd}$ set transform coefficient ISP2.

The order adjusting unit 136B generates an order-adjusted $2^{nd}$ set transform coefficient $ISP_{2_mo}$ by adjusting an order of the $2^{nd}$ set transform coefficient of the $2^{nd}$ order into the $1^{st}$ order. In the former order adjusting unit 136A of the $1^{st}$ or $2^{nd}$ embodiment, a lower order (e.g., $1^{st}$ order) is adjusted into a high order (e.g., $2^{nd}$ order). Yet, the order adjusting unit 136B of the $3^{rd}$ embodiment adjusts a high order (e.g., $2^{nd}$ order) into a low order (e.g., $1^{st}$ order).

Figure 10:
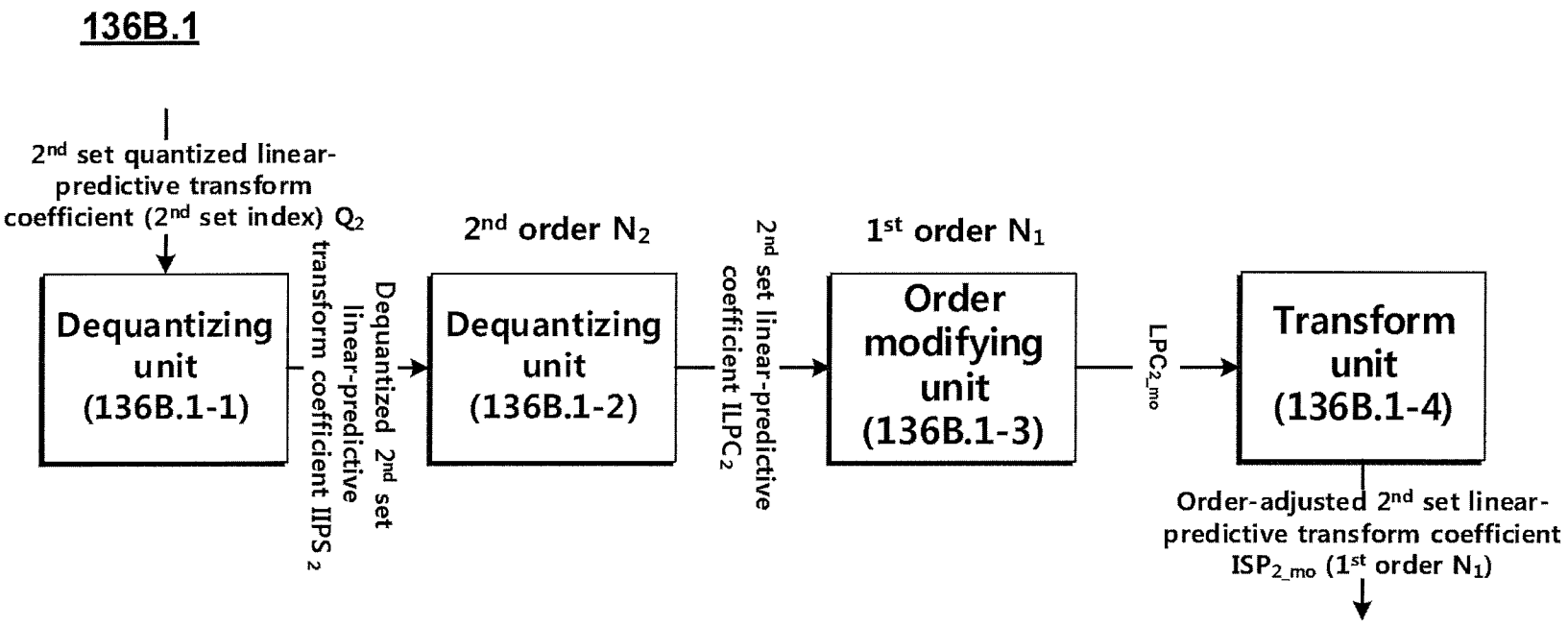
FIG. 10 is a detailed block diagram of an order adjusting unit 136B shown in FIG. 9 according to one embodiment.
Figure 11:
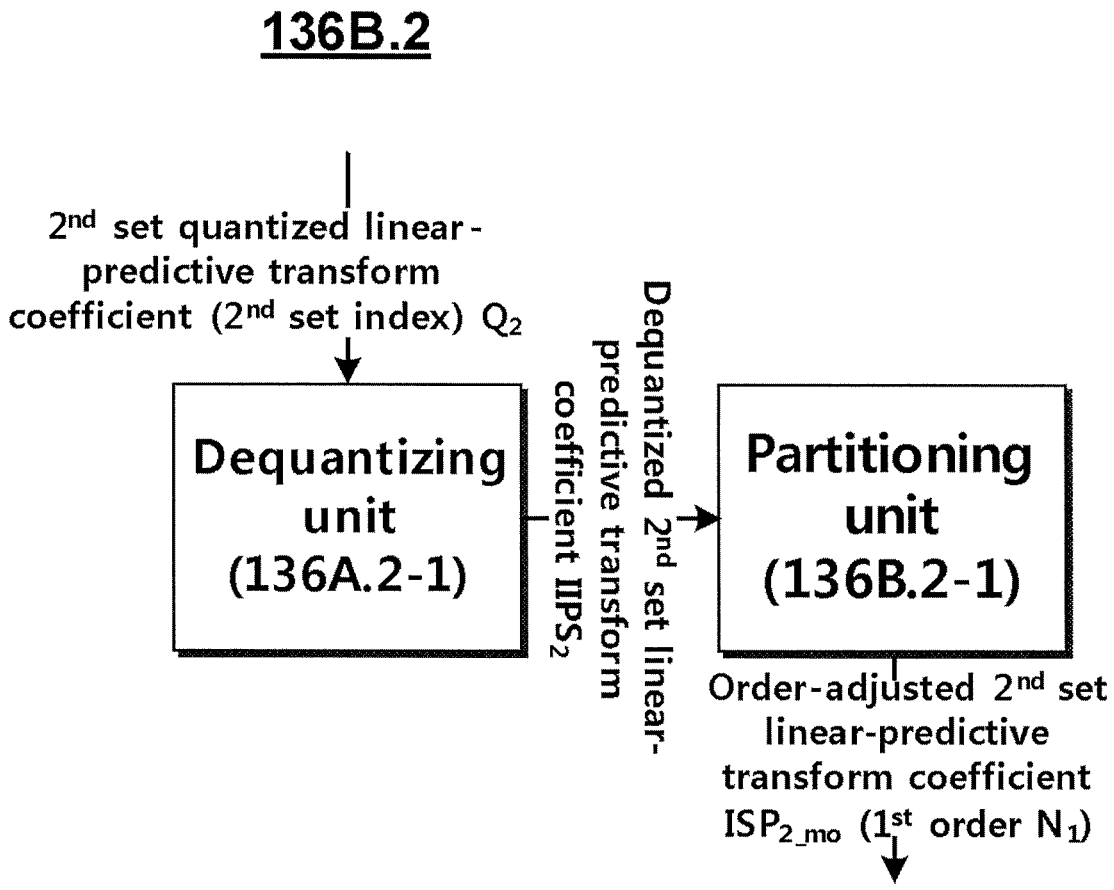
FIG. 11 is a detailed block diagram of an order adjusting unit 136B shown in FIG. 9 according to another embodiment.

FIG. 10 and FIG. 11 show embodiments 136B.1 and 136B.2 of the order adjusting unit 136B according to the $3^{rd}$ embodiment. The order adjusting unit 136B.1 according to one embodiment has a configuration almost identical to the detailed configuration of the former order adjusting unit 136A.1 according to one embodiment shown in FIG. 5. The order adjusting unit 136A.1 dequantizes/inverse-transforms the $1^{st}$ set index $Q_1$, adjusts an order into a $2^{nd}$ order from a $1^{st}$ order, and then transforms a coefficient. Yet, an order adjusting unit 136B.1 of the $3^{rd}$ embodiment dequantizes/inverse-transforms the $2^{nd}$ set index Q2, adjusts the order into the $1^{st}$ order from the $2^{nd}$ order, and then transforms a coefficient.

The dequantizing unit 136B.1 generates a dequantized $2^{nd}$ set linear-predictive transform coefficient $IISP_2$ by dequantizing the $2^{nd}$ set quantized linear-predictive transform coefficient (i.e., $2^{nd}$ set index $Q_2$). An inverse transform unit 136B.1-2 generates a $2^{nd}$ set linear-predictive coefficient $ILPC_2$ by inverse-transforming the $2^{nd}$ set linear-predictive transform coefficient $IISP_2$. An order modifying unit 136B.1-3 generates an order adjusted $2^{nd}$ set linear-predictive coefficient $LPC_{2_mo}$ by estimating a $1^{st}$ order of a low order using an order of the $2^{nd}$ set linear-predictive coefficient $ILPC_2$ of the $2^{nd}$ order that is a high order. For instance, 10 linear-predictive coefficients are estimated using 16 linear-predictive coefficients. In doing so, a modified Levinson-Durbin algorithm or a lattice structured recursive method may be usable. A transform unit 146B.1-4 generates an order adjusted $2^{nd}$ set linear-predictive transform coefficient $ISP_{2_mo}$ by transforming the $2^{nd}$ set linear-predictive coefficient $LPC_{2_mo}$ of the $1^{st}$ order.

Meanwhile, FIG. 11 shows an order adjusting unit 136B.2 according to another embodiment. The order adjusting unit 136B.2 shown in FIG. 1 differs from the former embodiment 136A.2 in adjusting a high order (e.g., $2^{nd}$ order) into a low order (e.g., $1^{st}$ order) and performing partitioning rather than performing padding.

The dequantizing unit 136B.2-1 generates a dequantized $2^{nd}$ set linear-predictive transform coefficient $IISP_2$ by dequantizing the $2^{nd}$ set quantized linear-predictive transform coefficient (i.e., $2^{nd}$ set index $Q_2$). A partitioning unit 136B.2-1 generates a $2^{nd}$ set linear-predictive transform coefficient ISP2_mo order-adjusted into the $1^{st}$ order by partitioning a $2^{nd}$ linear-predictive transform coefficient of the $2^{nd}$ order into the $1^{st}$ order of the low order and the rest and then taking the $1^{st}$ order only.

Thus, the order adjusting unit 136B adjusts the $2^{nd}$ order into the $1^{st}$ order. Referring now to FIG. 8, the adder 137 generates a $1^{st}$ set difference $d_1$ by subtracting the order-adjusted $2^{nd}$ set linear-predictive transform coefficient $ISP_{2_mo}$ having its order adjusted into the $1^{st}$ order from the $1^{st}$ set linear-predictive transform coefficient $ISP_2$ of the $1^{st}$ order. And, the $2^{nd}$ quantizing unit 138 generates a $1^{st}$ set difference (i.e., $1^{st}$ set index) $Qd_1$ by quantizing the $1^{st}$ set difference $d_1$.

Thus, according to the $3^{rd}$ embodiment shown in FIGS. 8 to 11, it may be able to quantize coefficients of a low order (e.g., $1^{st}$ order) with reference to coefficients of a high order (e.g., $2^{nd}$ order). Like the $2^{nd}$ embodiment 130A' as the extended example of the $1^{st}$ embodiment, the $3^{rd}$ embodiment may be extended up to a $3^{rd}$ set linear-predictive coefficient. In particular, a $3^{rd}$ set is used for quantization of a $2^{nd}$ set (high order) and a $1^{st}$ set (high order) with reference to a $3^{rd}$ set (a highest order). In more particular, a $3^{rd}$ set coefficient $LPC_3$ is generated irrespective of order information. Whether to generate a $2^{nd}$ set coefficient $LPC_2$ and a $1^{st}$ set coefficient $LPC_1$ is determined in accordance with the order information. Namely, in case of the $3^{rd}$ order, the $1^{st}$ and $2^{nd}$ set coefficients are not generated. In case of the $2^{nd}$ order, the $2^{nd}$ set coefficient is generated only. In case of the $1^{st}$ order, the $1^{st}$ and $2^{nd}$ set coefficients are generated.

FIG. 12 is a detailed block diagram of the linear prediction analyzing unit 130 shown in FIG. 1 according to a $4^{th}$ embodiment 130C. As mentioned in the foregoing description of the order generating unit 126, the $4^{th}$ embodiments relates to a case of determining various orders on the same band rather than determining various orders on various bands. In doing so, a low order and a high order shall be named $N1^{th}$ order and $N2^{th}$ order, respectively.

The $4^{th}$ embodiment shown in FIG. 12 is based on a low order, which is almost identical to the $1^{st}$ embodiment. Functions of the components of the $4^{th}$ embodiment are almost identical to those of the $1^{st}$ embodiment except that the $1^{st}$ order and the $2^{nd}$ order are replaced by the $N1^{th}$ order and the $N2^{th}$ order, respectively. Hence, details of the components of the $4^{th}$ embodiment may refer to those of the $1^{st}$ embodiment.

Figure 13:
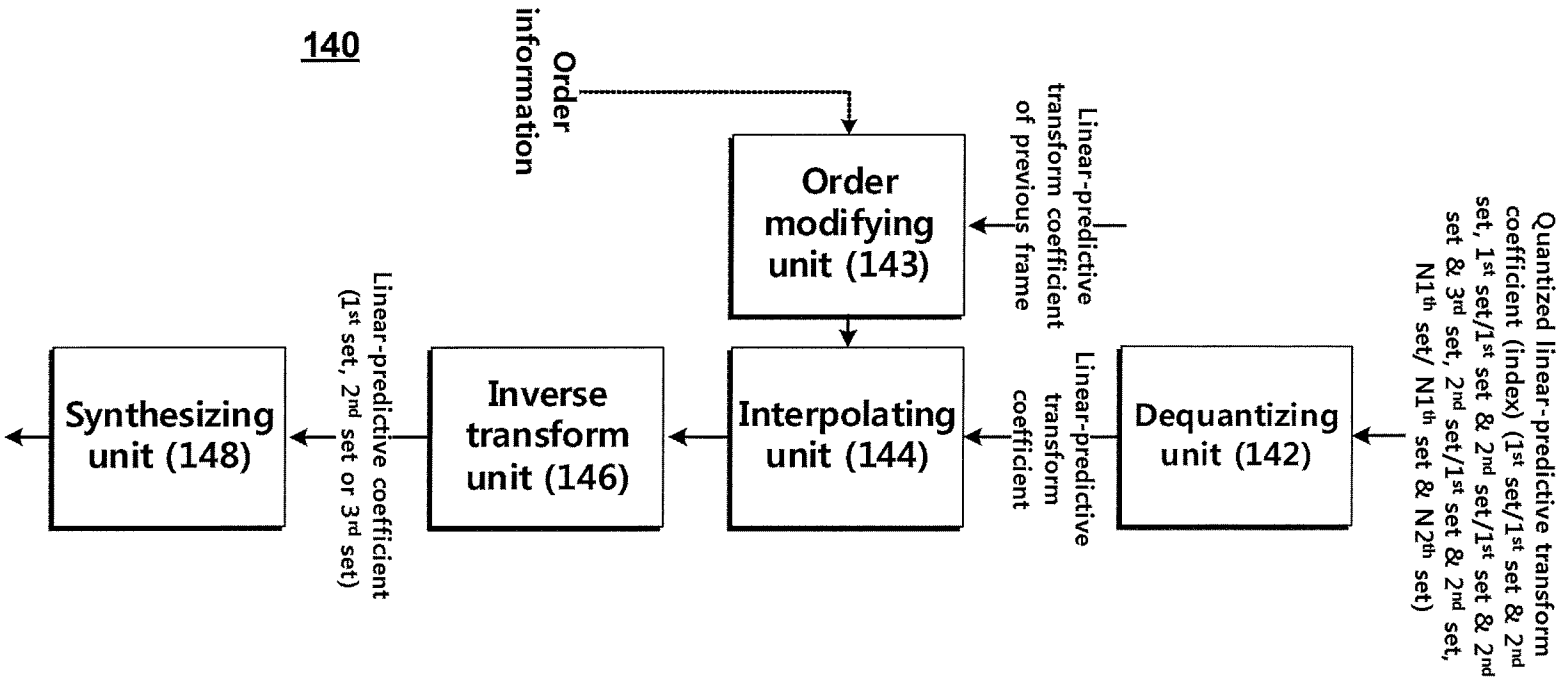
FIG. 13 is a detailed block diagram of a linear prediction synthesizing unit 140 shown in FIG. 1 according to an embodiment.

FIG. 13 is a detailed block diagram of the linear prediction synthesizing unit 140 shown in FIG. 1 according to an embodiment. Referring to FIG. 13, the linear prediction synthesizing unit 140 includes a dequantizing unit 146, an order modifying unit 143, an interpolating unit 144, an inverse transform unit 146, and a synthesizing unit 148.

The dequantizing unit 142 generates a linear-predictive transform coefficient by receiving a quantized linear-predictive transform coefficient (index) from the linear prediction analyzing unit 130 and then dequantizing the received coefficient.

From the linear prediction analyzing unit 130A according to the $1^{st}$ embodiment, the dequantizing unit 142 receives a $1^{st}$ set index (in case of a $1^{st}$ order) or receives a $1^{st}$ set index and a $2^{nd}$ set index (in case of a $2^{nd}$ order). In case of the $1^{st}$ order, the $1^{st}$ set index is dequantized. In case of the $2^{nd}$ order, the $1^{st}$ set index and the $2^{nd}$ set index are respectively dequantized and then added together.

From the linear prediction analyzing unit 130A' according to the $2^{nd}$ embodiment, the case of the $1^{st}$ order or the $2^{nd}$ order is identical to that of the $1^{st}$ embodiment. In case of a $3^{rd}$ order, the dequantizing unit 142 receives the $1^{st}$ to $3^{rd}$ indexes all, dequantizes each of the received indexes, and then adds them together.

From the linear prediction analyzing unit 130B according to the $3^{rd}$ embodiment, the dequantizing unit 142 receives both of the $1^{st}$ set index and the $2^{nd}$ set index (in case of a $1^{st}$ order) or receives the $2^{nd}$ set index only (in case of a $2^{nd}$ order). In case of the $1^{st}$ order, the $1^{st}$ set index and the $2^{nd}$ set index are dequantized and then added together.

From the linear prediction analyzing unit 130C according to the $4^{th}$ embodiment, the dequantizing unit 142 receives $N1^{th}$ set (in case of $N1^{th}$ order) or receives both $N1^{th}$ set and $N2^{th}$ set (in case of $N2^{th}$ order). Likewise, the $N1^{th}$ set and the $N2^{th}$ set are respectively dequantized and then added together.

Meanwhile, the order modifying unit 143 receives linear-predictive transform coefficients of previous frame and/or next frame and then selects at least one frame as a target to interpolate. Subsequently, based on the order information, the order modifying unit 143 estimates an order of the coefficients of the frame, which corresponds to the target, as an order (e.g., $1^{st}$ order, $2^{nd}$ order, $3^{rd}$ order, etc.) of a linear-predictive transform coefficient of a current frame. For this process, an algorithm (e.g., a modified Levinson-Durbin algorithm, a lattice structured recursive method, etc.) for the order adjusting unit 136A/136B to adjust a low order into a high order (or to adjust a high order into a low order) may be usable.

If the interpolated target frame corresponds to a previous frame (e.g., previous and/or next order-different frame instead of a subframe within a current frame), the interpolating unit 144 interpolates a linear-predictive transform coefficient of the current frame, which is an output of the dequantizing unit 142) using the linear-predictive transform coefficient of the previous and/or next frame order-modified by the order modifying unit 143.

The inverse transform unit 146 generates a linear-predictive coefficient of a current frame by inverse transforming the interpolated linear-predictive transform coefficient of the current frame. For instance, the inverse transform unit 146 generates a linear-predictive coefficient of a $1^{st}$ set in case of a $1^{st}$ order. For another instance, the inverse transform unit 146 generates a linear-predictive coefficient of a $2^{nd}$ set in case of a $2^{nd}$ order. For another instance, the inverse transform unit 146 generates a linear-predictive coefficient of a $3^{rd}$ set in case of a $3^{rd}$ order.

The synthesizing unit 148 generates a linear-predictive synthesized signal by performing a linear-predictive synthesis based on a linear-predictive coefficient. It is a matter of course that the synthesizing unit 148 can be integrated into a single filter together with the adder 150 shown in FIG. 1.

In the above description, the encoder of the audio signal processing apparatus according to the embodiment of the present invention is explained with reference to FIG. 1 and various embodiments of the respective components (e.g., the order determining unit 120, the linear prediction analyzing unit 130, etc.) are explained with reference to FIGS. 2 to 13. In the following description, a decoder is explained with reference to FIG. 14.

Figure 14:
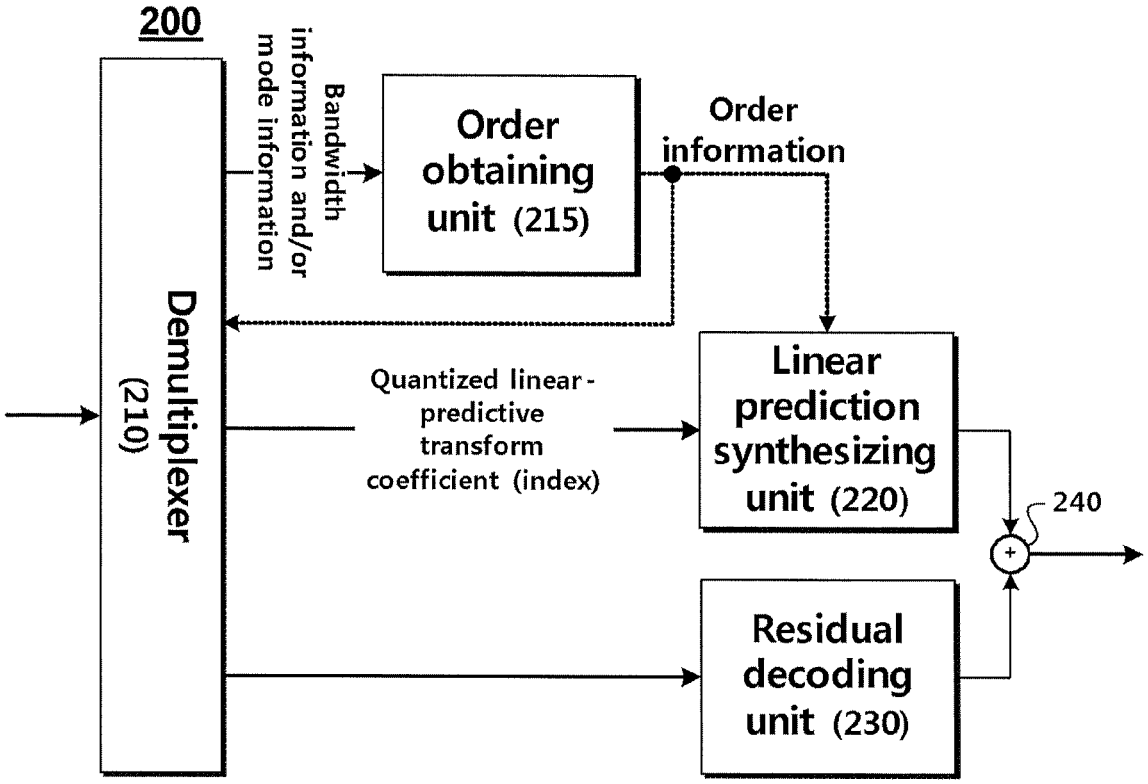
FIG. 14 is a block diagram of a decoder of an audio signal processing apparatus according to an embodiment of the present invention.

FIG. 14 is a block diagram of a decoder of an audio signal processing apparatus according to an embodiment of the present invention. A decoder 200 may include a demultiplexer 210, an order obtaining unit 215, a linear prediction synthesizing unit 220 and a residual decoding unit 130.

The demultiplexer 210 extracts: 1) bandwidth information; 2) coding mode information; or 3) bandwidth information and coding mode information from at least one bitstream and then delivers the extracted information(s) to the order obtaining unit 215.

The order obtaining unit 215 determines order information by referring to a table based on: 1) the extracted bandwidth information; 2) the extracted coding mode information; or 3) the extracted bandwidth information and the extracted coding mode information. This determining process may be identical to that of the order generating unit 126 shown in FIG. 2 and its details shall be omitted. In particular, the table is the information agreed between the encoder and the decoder, and more particularly, between the order generating unit 126 of the encoder and the order obtaining unit 215 of the decoder and may correspond to order information per band, order information per coding mode and/or the like.

One example of the table is shown in Table 1 in the following, by which the present invention may be non-limited.

TABLE 1

| Bandwidth information | | Order (or temporary order) |
|---|---|---|
| $1^{st}$ band | Narrow band | 10 |
| $2^{nd}$ band | Wide band | 16 |
| $3^{rd}$ band | Ultra wide band | 20 |

TABLE 2

| Coding mode | | Order | |
|---|---|---|---|
| $1^{st}$ coding mode | Un-voice coding mode | Temporary order −4 | 4 |
| $2^{nd}$ coding mode | Transition coding mode | Temporary order −2 | 10 |
| $3^{rd}$ coding mode | Generic coding mode | Temporary order +0 | 16 |
| $4^{th}$ coding mode | Voice coding mode | Temporary order +2 | 20 |

Thus, the order information obtained by the order obtaining unit 215 is delivered to the multiplexer 210 and the linear prediction synthesizing unit 220.

The multiplexer 210 parses the linear-predictive transform coefficient quantized by a difference indicated by order information of a current frame from the bitstream and then delivers the coefficient to the linear prediction synthesizing unit 220.

The linear prediction synthesizing unit 220 generates a linear-predictive synthesized signal based on the order information and the quantized linear-predictive transform coefficient. In particular, the linear prediction synthesizing unit 220 generates a dequantized linear-predictive coefficient by dequantizing/inverse-transforming the quantized linear-predictive transform coefficient based on the order information. Subsequently, the linear prediction synthesizing unit generates the linear-predictive synthesized signal by performing linear-predictive synthesis. This process may correspond to the former process for calculating the right side in Formula 2.

Meanwhile, the residual decoding unit 230 predicts a linear-predictive residual signal using parameters (e.g., pitch gain, pitch delay, codebook gain, codebook index, etc.) for the linear-predictive residual signal. In particular, the residual decoding unit 230 predicts a pitch residual component using the codebook index and the codebook gain and then performs a long-term synthesis using the pitch gain and the pitch delay, thereby generating a long-term synthesized signal. And, the residual decoding unit 230 is able to generate the linear-predictive residual signal by adding the long-term synthesized signal and the pitch residual component together. The adder 240 then generates an audio signal for the current frame by adding the linear-predictive synthesized signal and the linear-predictive residual signal together.

The audio signal processing apparatus according to the present invention is available for various products to use. Theses products can be mainly grouped into a stand alone group and a portable group. A TV, a monitor, a settop box and the like can be included in the stand alone group. And, a PMP, a mobile phone, a navigation system and the like can be included in the portable group.

Figure 15:
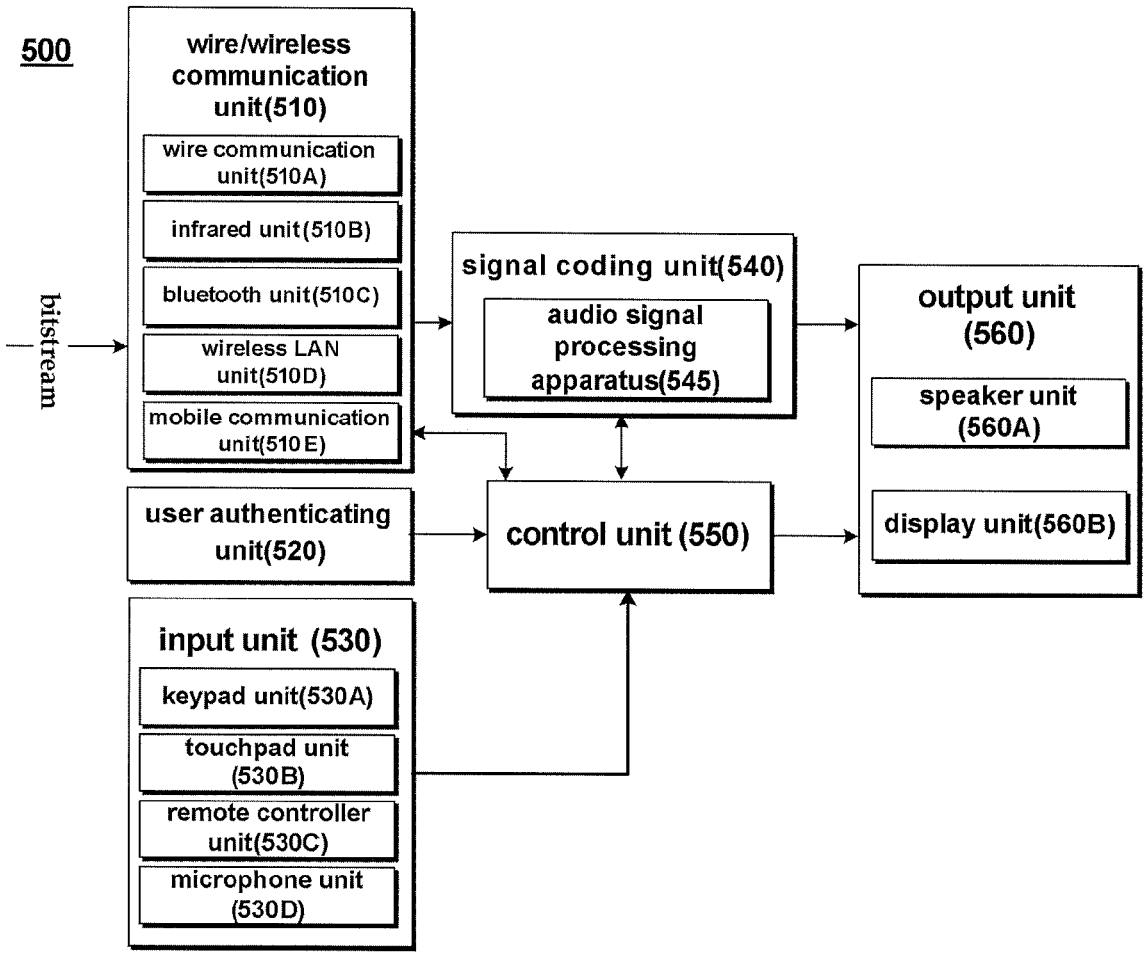
FIG. 15 is a schematic block diagram of a product in which an audio signal processing apparatus according to one embodiment of the present invention is implemented.

FIG. 15 shows relations between products, in which an audio signal processing apparatus according to an embodiment of the present invention is implemented. Referring to FIG. 15, a wire/wireless communication unit 510 receives a bitstream via wire/wireless communication system. In particular, the wire/wireless communication unit 510 may include at least one of a wire communication unit 510A, an infrared unit 510B, a Bluetooth unit 510C, a wireless LAN unit 510D and a mobile communication unit 510E.

A user authenticating unit 520 receives an input of user information and then performs user authentication. The user authenticating unit 520 can include at least one of a fingerprint recognizing unit, an iris recognizing unit, a face recognizing unit and a voice recognizing unit. The fingerprint recognizing unit, the iris recognizing unit, the face recognizing unit and the voice recognizing unit receive fingerprint information, iris information, face contour information and voice information and then convert them into user informations, respectively. Whether each of the user informations matches pre-registered user data is determined to perform the user authentication.

An input unit 530 is an input device enabling a user to input various kinds of commands and can include at least one of a keypad unit 530A, a touchpad unit 530B, a remote controller unit 530C and a microphone unit 530D, by which the present invention is non-limited. In particular, the microphone unit 530D is an input device configured to receive a voice or audio signal. In this case, each of the keypad unit 530A, the touchpad unit 530B and the remote controller unit 530C is able to receive an input of a command for an outgoing call, an input of a command for activating the microphone unit 430D, and/or the like. In case of receiving the command for the outgoing call via the keypad unit 530B or the like, the controller 550 may control the mobile communication unit 510E to make a request for a call to a communication network of the same.

A signal coding unit 540 performs encoding or decoding on an audio signal and/or a video signal, which is received via microphone unit 530D or the wire/wireless communication unit 510, and then outputs an audio signal in time domain. The signal coding unit 540 includes an audio signal processing apparatus 545. As mentioned in the foregoing description, the audio signal processing apparatus 545 corresponds to the above-described embodiment (i.e., the encoder 100 and/or the decoder 200) of the present invention. Thus, the audio signal processing apparatus 545 and the signal coding unit including the same can be implemented by at least one or more processors.

A control unit 550 receives input signals from input devices and controls all processes of the signal decoding unit 540 and an output unit 560. In particular, the output unit 560 is an element configured to output an output signal generated by the signal decoding unit 540 and the like and can include a speaker unit 560A and a display unit 560B. If the output signal is an audio signal, it is outputted to a speaker. If the output signal is a video signal, it is outputted via a display.

Figure 16:
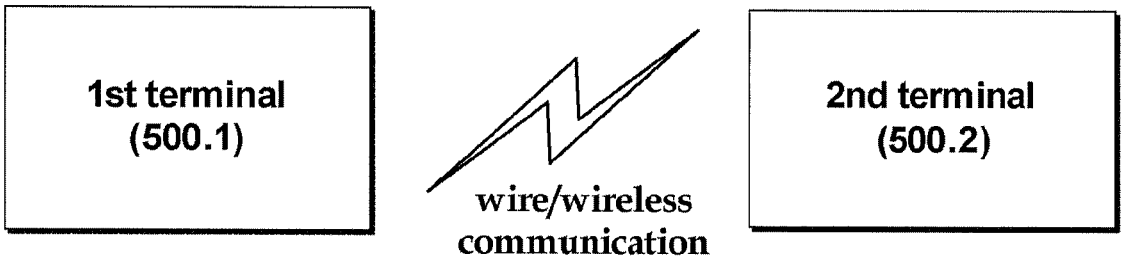
FIG. 16 is a diagram for relations between products in which an audio signal processing apparatus according to one embodiment of the present invention is implemented.
Figure 16:
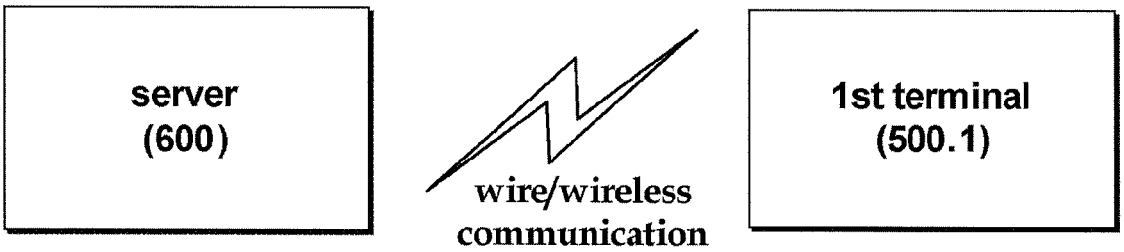

FIG. 16 is a diagram for relations of products provided with an audio signal processing apparatus according to an embodiment of the present invention. FIG. 16 shows the relation between a terminal and server corresponding to the products shown in FIG. 15. Referring to FIG. 16 (A), it can be observed that a first terminal 500.1 and a second terminal 500.2 can exchange data or bitstreams bi-directionally with each other via the wire/wireless communication units. Referring to FIG. 16 (B), it can be observed that a server 600 and a first terminal 500.1 can perform wire/wireless communication with each other.

Figure 17:
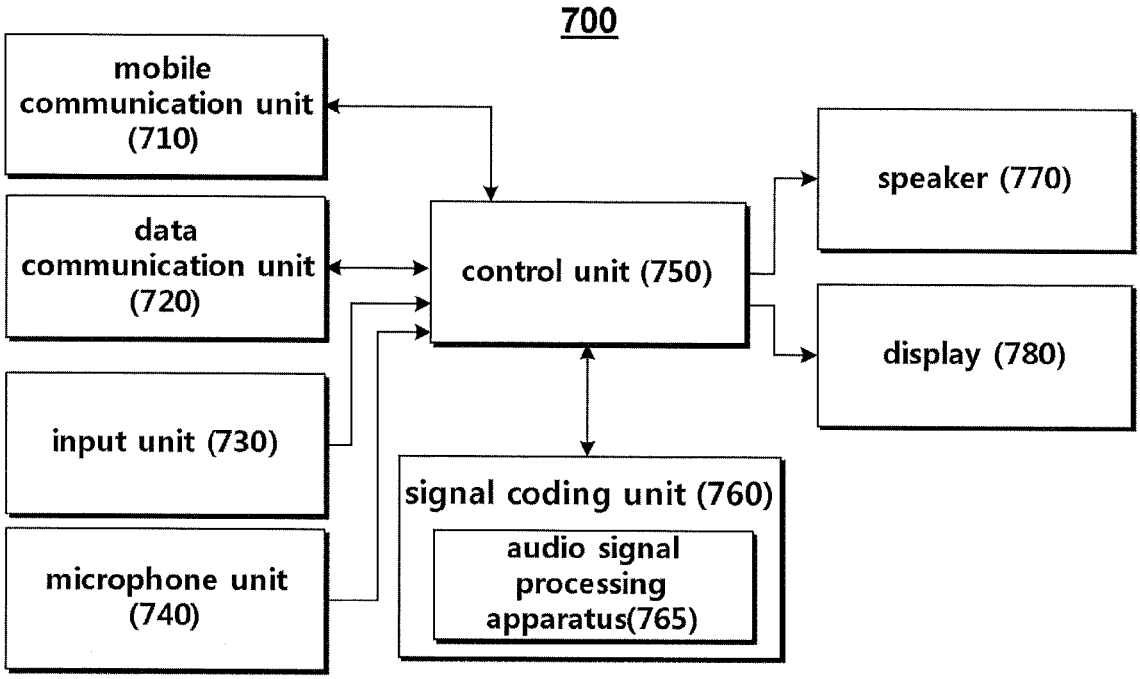
FIG. 17 is a schematic block diagram of a mobile terminal in which an audio signal processing apparatus according to one embodiment of the present invention is implemented.

FIG. 17 is a schematic block diagram of a mobile terminal in which an audio signal processing apparatus according to one embodiment of the present invention is implemented. Referring to FIG. 17, a mobile terminal 700 may include a mobile communication unit 710 configured for an outgoing call and an incoming call, a data communication unit 720 configured for data communications, an input unit 730 configured to input a command for an outgoing call or an audio input, a microphone unit 740 configured to input a voice signal or an audio signal, a control unit 750 configured to control the respective components of the mobile terminal 700, a signal coding unit 760, a speaker 770 configured to output a voice signal or an audio signal, and a display 780 configured to output a screen.

The signal coding unit 760 performs encoding or decoding on an audio signal and/or a video signal received via the mobile communication unit 710, the data communication unit 720 and/or the microphone unit 530D and outputs an audio signal in time domain via the mobile communication unit 710, the data communication unit 720 and/or the speaker 770. The signal coding unit 760 may include an audio signal processing apparatus 765. As mentioned in the foregoing description, the audio signal processing apparatus 765 corresponds to the above-described embodiment (i.e., the encoder 100 and/or the decoder 200) of the present invention. Thus, the audio signal processing apparatus 765 and the signal coding unit including the same may be implemented by at least one or more processors.

An audio signal processing method according to the present invention can be implemented into a computer-executable program and can be stored in a computer-readable recording medium. And, multimedia data having a data structure of the present invention can be stored in the computer-readable recording medium. The computer-readable media include all kinds of recording devices in which data readable by a computer system are stored. The computer-readable media include ROM, RAM, CD-ROM, magnetic tapes, floppy discs, optical data storage devices, and the like for example and also include carrier-wave type implementations (e.g., transmission via Internet). And, a bitstream generated by the above mentioned encoding method can be stored in the computer-readable recording medium or can be transmitted via wire/wireless communication network.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

INDUSTRIAL APPLICABILITY

Accordingly, the present invention is applicable to encoding and decoding an audio signal.

What is claimed is:

1. A method of processing an audio signal, comprising the steps of:

determining bandwidth information indicating that a current frame corresponds to which one among a plurality of bands including a $1^{st}$ band and a $2^{nd}$ band by performing a spectrum analysis on the current frame of the audio signal;

determining order information corresponding to the current frame based on the bandwidth information;

generating a $1^{st}$ set linear-predictive transform coefficient of a $1^{st}$ order by performing a linear-predictive analysis on the current frame;

generating a $1^{st}$ set index by vector-quantizing the $1^{st}$ set linear-predictive transform coefficient;

generating a $2^{nd}$ set linear-predictive transform coefficient of a $2^{nd}$ order in accordance with the order information by performing the linear-predictive analysis on the current frame; and if the $2^{nd}$ set linear-predictive transform coefficient is generated, performing a vector-quantization on a $2^{nd}$ set difference using the $1^{st}$ set index and the $2^{nd}$ set linear-predictive transform coefficient.

2. The method of claim 1, wherein a plurality of the bands further comprises a $3^{rd}$ band, and wherein the method further comprises the steps of generating a $3^{rd}$ set linear-predictive transform coefficient of a $3^{rd}$ order in accordance with the order information by performing the linear-predictive analysis on the current frame, and performing quantization on a $3^{rd}$ set difference corresponding to a difference between an order-adjusted $2^{nd}$ set linear-predictive transform coefficient and the $3^{rd}$ set linear-predictive transform coefficient.

3. The method of claim 1, wherein if the bandwidth information indicates the $1^{st}$ band, the order information is determined as a previously determined $1^{st}$ order, and wherein if the bandwidth information indicates the $2^{nd}$ band, the order information is determined as a previously determined $2^{nd}$ order.

4. The method of claim 1, wherein the first order is smaller than the $2^{nd}$ order.

5. The method of claim 1, further comprising the step of generating coding mode information indicating one of a plurality of modes including a $1^{st}$ mode and a $2^{nd}$ mode for the current frame, wherein the order information is further determined based on the coding mode information.

6. The method of claim 1, wherein the order information determining step comprising the steps of:

generating coding mode information indicating one of a plurality of modes including a $1^{st}$ mode and a $2^{nd}$ mode for the current frame;

determining a temporary order based on the bandwidth information;

determining a correction order in accordance with the coding mode information; and determining the order information based on the temporary order and the correction order.

7. An apparatus for of processing an audio signal, comprising:

a bandwidth determining unit configured to determine bandwidth information indicating that a current frame corresponds to which one among a plurality of bands including a $1^{st}$ band and a $2^{nd}$ band by performing a spectrum analysis on the current frame of the audio signal;

an order determining unit configured to determine order information corresponding to the current frame based on the bandwidth information;

a linear-predictive coefficient generating/transforming unit configured to generate a $1^{st}$ set linear-predictive transform coefficient of a $1^{st}$ order by performing a linear-predictive analysis on the current frame, the linear-predictive coefficient generating/transforming unit configured to generate a $2^{nd}$ set linear-predictive transform coefficient of a $2^{nd}$ order in accordance with the order information;

a $1^{st}$ quantizing unit configured to generate a $1^{st}$ set index by vector-quantizing the $1^{st}$ set linear-predictive transform coefficient; and a $2^{nd}$ quantizing unit, if the $2^{nd}$ set linear-predictive transform coefficient is generated, performing a vector-quantization on a $2^{nd}$ set difference using the $1^{st}$ set index and the $2^{nd}$ set linear-predictive transform coefficient.

8. The apparatus of claim 7, wherein a plurality of the bands further comprises a $3^{rd}$ band, wherein the linear-predictive coefficient generating/transforming unit further generates a $3^{rd}$ set linear-predictive transform coefficient of a $3^{rd}$ order in accordance with the order information by performing the linear-predictive analysis on the current frame, and wherein the apparatus further comprises a $3^{rd}$ quantizing unit configured to perform quantization on a $3^{rd}$ set difference corresponding to a difference between an order-adjusted $2^{nd}$ set linear-predictive transform coefficient and the $3^{rd}$ set linear-predictive transform coefficient.

9. The apparatus of claim 7, wherein if the bandwidth information indicates the $1^{st}$ band, the order information is determined as a previously determined $1^{st}$ order and wherein if the bandwidth information indicates the $2^{nd}$ band, the order information is determined as a previously determined $2^{nd}$ order.

10. The apparatus of claim 7, wherein the first order is smaller than the $2^{nd}$ order.

11. The apparatus of claim 7, wherein the order determining unit further comprises a mode determining unit configured to generate coding mode information indicating one of a plurality of modes including a $1^{st}$ mode and a $2^{nd}$ mode for the current frame and wherein the order information is further determined based on the coding mode information.

12. The apparatus of claim 7, the order determining unit comprising:

a mode determining unit configured to generate coding mode information indicating one of a plurality of modes including a $1^{st}$ mode and a $2^{nd}$ mode for the current frame; and an order generating unit configured to determine a temporary order based on the bandwidth information, the order generating unit configured to determine a correction order in accordance with the coding mode information, the order generating unit configured to determine the order information based on the temporary order and the correction order.

* * * * *